United States Patent [19]

Toya et al.

[11] Patent Number: 4,634,653

[45] Date of Patent: Jan. 6, 1987

[54] DIRECT POSITIVE SILVER HALIDE PHOTOGRAPHIC EMULSION

[75] Inventors: Ichizo Toya; Yuji Mihara; Haruo Takei, all of Kanagawa, Japan

[73] Assignee: Fuji Photo Film Co., Ltd., Kanagawa, Japan

[21] Appl. No.: 712,474

[22] Filed: Mar. 18, 1985

Related U.S. Application Data

[63] Continuation of Ser. No. 526,926, Aug. 26, 1983, abandoned.

[30] Foreign Application Priority Data

Aug. 27, 1982 [JP] Japan ..... 57-148843

[51] Int. Cl.[4] ..... G03C 5/54; G03C 1/40; G03C 1/28; G03C 1/19

[52] U.S. Cl. ..... 430/217; 430/547; 430/560; 430/566; 430/577; 430/598

[58] Field of Search ..... 430/217, 598, 577, 547, 430/566, 560

[56] References Cited

U.S. PATENT DOCUMENTS

| | | | |
|---|---|---|---|
| 2,430,558 | 11/1947 | Carroll et al. | 430/577 |
| 3,759,713 | 9/1973 | Florens et al. | 430/577 |
| 3,822,136 | 7/1974 | Sakazume et al. | 430/577 |
| 3,951,666 | 4/1976 | Hinata et al. | 430/577 |
| 4,040,833 | 8/1977 | Hinata et al. | 430/577 |
| 4,276,364 | 6/1981 | Leone | 430/217 |
| 4,552,828 | 11/1985 | Toya et al. | 430/577 |

FOREIGN PATENT DOCUMENTS

| | | | |
|---|---|---|---|
| 37422 | 3/1977 | Japan | 430/577 |

*Primary Examiner*—Richard L. Schilling
*Attorney, Agent, or Firm*—Sughrue, Mion, Zinn, Macpeak and Seas

[57] ABSTRACT

A direct positive silver halide photographic emulsion which is able to provide a high maximum density and a low minimum density, and having a high developing progress. The emulsion contains at least one of the sensitizing dyes represented by following general formulate I, II, III, and IV and at least one of the compounds represented by general formulae V and VI;

Formula I

Formula II

Formula III

Formula IV

Formula V

Formula VI

The substituents are defined in the specification.

35 Claims, No Drawings

DIRECT POSITIVE SILVER HALIDE PHOTOGRAPHIC EMULSION

FIELD OF THE INVENTION

This invention relates to silver halide photographic emulsions. Specifically, the invention relates to direct positive silver halide photographic emulsions and more particularly to internal latent image type silver halide photographic emulsions which are useful for obtaining direct positive images by processing with a surface developer in the presence of a fogging agent. Furthermore, the invention relates to spectrally sensitized silver halide photographic emulsions useful for obtaining direct positive images by the aforesaid process.

BACKGROUND OF THE INVENTION

Processes of obtaining direct positive images by processing internal latent image type silver halide photoemulsions with a surface developer in the presence of a fogging agent as well as silver halide photographic emulsions and photographic materials used for such processes are disclosed in, for example, U.S. Pat. Nos. 2,456,953; 2,497,875; 2,497,876; 2,588,982; 2,675,318; 3,227,552; and 2,592,250; British Pat. Nos. 1,151,363 and 1,011,062; Japanese Patent Publication No. 29,405/'68, etc. By an internal latent image type silver halide photographic emulsion is meant a silver halide photographic emulsion having photosensitive nuclei mainly in the inside of silver halide grains and forming latent images mainly in the inside of the silver halide grains caused by the internal photosensitive nuclei. A photographic emulsion composed of such silver halide grains is not substantially developed by a surface developer.

By the term "surface developer" is meant a developer which develops a surface latent image of silver halide grains but substantially does not develop an internal latent image. A surface developer or the composition thereof contains a conventional silver halide developing agent but must not substantially contain a silver halide solvent (e.g., a water-soluble thiocyanate, a water-soluble thiosulfate, ammonia, etc.) used for forming internal latent images. The surface developer preferably includes a slightly excessive amount of halide or excessive halide can be incorporated in a silver halide emulsion as a halide-releasing compound. However, the use of a large amount of halide should generally be avoided in order to prevent the substantial decomposition or dissolution of silver halide grains.

In the above-described process of obtaining a direct positive image, a fogging agent may be incorporated in a developer or may be incorporated in a silver halide photographic emulsion layer of a photographic material or other layer thereof.

In a silver halide photographic material, silver halide photographic emulsions are generally spectrally sensitized.

For employing the foregoing process of obtaining a direct positive image in the presence of a fogging agent in many application fields regarding photography, improvements of various photographic characteristics such as the improvement of photographic speed, the improvement of the maximum density (Dmax), the reduction of the minimum density (Dmin), the suppression of the occurrence of re-reversal images, etc., have been desired.

SUMMARY OF THE INVENTION

An object of this invention is to provide an internal latent image type direct positive silver halide photographic emulsion having the above-mentioned improved photographic characteristics.

A particular object of this invention is to improve the reversal property of an internal latent image type silver halide photographic emulsion in the process of obtaining a direct positive image by surface-developing the silver halide photographic emulsion in the presence of a fogging agent. That is, the object of this invention is to provide a direct positive silver halide photographic emulsion which is able to provide a high maximum density and a low minimum density, and having a high developing progress.

Another object of this invention is to provide a direct positive internal latent image type silver halide photographic emulsion giving a high maximum density and showing a high developing progress in a diffusion transfer process, in particular a dye diffusion transfer process for obtaining a direct positive image by surface-developing the internal latent image type silver halide photographic emulsion in the presence of a fogging agent.

The above-described objects of this invention have been achieved by a direct positive silver halide photographic emulsion containing at least one of the sensitizing dyes represented by the following general formulae I, II, III, and IV and at least one of the compounds represented by the following general formulae V and VI:

Formula I

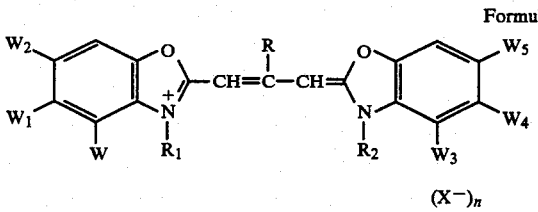

wherein $W_1$ and $W_4$ each represents a hydrogen atom, a halogen atom, an alkyl group, an alkoxy group, a hydroxy group, an acyloxy group, or a phenyl group; $W_2$ and $W_5$ each represents a hydrogen atom, a halogen atom, or an alkyl group; W and $W_3$ each represents a hydrogen atom; said W and $W_1$, said $W_1$ and $W_2$, said $W_3$ and $W_4$, and said $W_4$ and $W_5$ may, taken together, form a benzene ring, R represents an alkyl group; $R_1$ and $R_2$ each represents an alkyl group or a substituted alkyl group; X represents an acid anion; and n represents 0 or 1;

Formula II

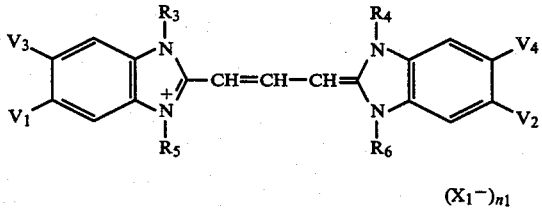

wherein $V_1$, $V_2$, $V_3$, and $V_4$ each represents a hydrogen atom, a halogen atom, a trifluoromethyl group, a cyano group, a carboxy group, an alkoxycarbonyl group, an aminosulfonyl group, or an alkylsulfonyl group; $R_3$, $R_4$, $R_5$, and $R_6$ each represents an alkyl group or a substituted alkyl group; $X_1$ represents an acid anion; and $n_1$ represents 0 or 1;

Formula III

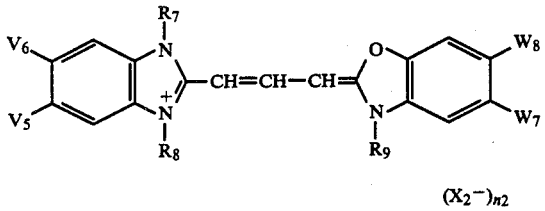

wherein $V_5$, $V_6$, $R_7$, and $R_8$ each has the same significance as $V_1$, $V_3$, $R_3$, and $R_5$, respectively, in general formula II; $W_6$, $W_7$, $W_8$, and $W_9$ each has the same significance as W, $W_1$, $W_2$, and $R_1$, respectively, in general formula I; $X_2$ represents an acid anion; and $n_2$ represents 0 or 1;

Formula IV

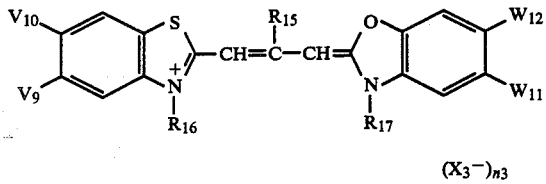

wherein $R_{15}$ represents an alkyl group; $R_{16}$ and $R_{17}$ each represents an alkyl group or a substituted alkyl group; $V_9$, $V_{10}$, $W_{11}$, and $W_{12}$ each has the same significance as $W_1$ in general formula I; $X_3$ represents an acid anion; and $n_3$ represents 0 or 1;

Formula V

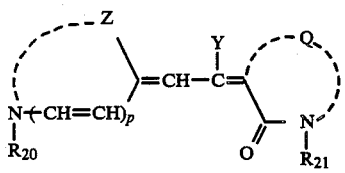

and

Formula VI

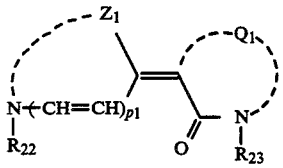

wherein Z and $Z_1$ each represents a non-metallic atomic group necessary for completing a thiazole nucleus, a thiazoline nucleus, a selenazole nucleus, a selenazoline nucleus, a pyrrolidine nucleus, a pyridine nucleus, an oxazole nucleus, an oxazoline nucleus, an imidazole nucleus, an indolenine nucleus, a tetrazole nucleus, a benzothiazole nucleus, a benzoselenazole nucleus, a benzoimidazole nucleus, a benzoxazole nucleus, a naphthothiazole nucleus, a naphthoselenazole nucleus, a naphthoxazole nucleus, a naphthoimidazole nucleus, or a quinoline nucleus; Q and $Q_1$ each represents a non-metallic atomic group necessary for completing a rhodanine nucleus, a 2-thiooxazolidine-2,4-dione nucleus, a 2-thioselenazolidine-2,4-dione nucleus, a barbituric acid nucleus, 2-thiobarbituric acid or a 2-thiohydantoin nucleus; $R_{20}$, $R_{21}$, $R_{22}$, and $R_{23}$ each represents a hydrogen atom, an alkyl group, a substituted alkyl group, an aryl group, or an allyl group; Y represents a hydrogen atom, an alkyl group, or an aryl group; and p and $p_1$ each represents 0 or 1.

DESCRIPTION OF THE PREFERRED EMBODIMENT

Compounds represented by the above-mentioned general formulae will now be explained in detail.

The alkyl group shown by $R_1$, $R_2$, $R_3$, $R_4$, $R_5$, $R_6$, $R_7$, $R_8$, $R_9$, $R_{16}$ or $R_{17}$ in general formulae I to IV are substituted or unsubstituted alkyl groups preferably each having 1 to 6 carbon atoms, more preferably 1 to 4 carbon atoms in the alkyl group or moiety.

Examples of the unsubstituted alkyl group include a methyl group, an ethyl group, an n-propyl group, an n-butyl group, etc.

Examples of the substituted alkyl group includes a hydroxylalkyl group (e.g., β-hydroxyethyl, -propyl or -butyl group, etc.); an acetoxyalkyl group (e.g., β-acetoxyethyl group, γ-acetoxypropyl group, etc.); an alkoxyalkyl group preferably having 1 to 4 carbon atoms in the alkoxy moiety (e.g., β-methoxyethyl group, γ-methoxypropyl group, etc.); an alkoxycarbonylalkyl group preferably having 1 to 4 carbon atoms in the alkoxy moiety (e.g., β-methoxycarbonylethyl group, γ-methoxycarbonylpropyl group, δ-ethoxycarbonylbutyl group, etc.), a carboxyalkyl group (e.g., carboxymethyl group, β-carboxyethyl group, γ-carboxypropyl group, δ-carboxybutyl group, etc.); a substituted or unsubstituted alkyl group having a sulfo group such as a sulfoalkyl group (e.g., β-sulfoethyl group, γ-sulfopropyl group, γ-sulfobutyl group, δ-sulfobutyl group), a sulfoalkoxy alkyl group preferably having 1–4 carbon atoms in an alkoxy moiety (e.g., 2-(3-sulfopropoxy)ethyl group), a sulfoalkoxyalkoxy group preferably having 1–4 carbon atoms in an alkoxy moiety (e.g., 2-[2-(3-sulfopropoxy)ethoxy)] ethyl group, etc.); an alkenyl alkyl group preferably having 2–4 carbon atoms in an alkenyl moiety (e.g., vinylmethyl group, etc.); a cyanoalkyl group (e.g., β-cyanoethyl group, etc.); a carbamoylalkyl group (e.g., β-carbamoylethyl group, etc.); an aralkyl group (e.g., 2-phenethyl group, 3-phenylpropyl group, etc.); an aryloxyalkyl group (e.g., 2-phenoxyethyl group, 3-phenoxypropyl group, etc.); a sulfamoyl alkyl group (e.g., sulfamoyl propyl group); the carbamoyl alkyl group and sulfamoyl alkyl group may be further substituted with one or two alkyl groups (preferably having 1–4 carbon atoms) or an aryl group (preferably having 6–10 carbon atoms), furthermore two substituted alkyl groups may constitute a heterocyclic ring with at least one nitrogen atom or at least one nitrogen atom and at least one hetero atom other than nitrogen atom (e.g., oxygen atom); and the like.

Preferred examples of the alkyl group shown by R in general formula I and $R_5$ in general formula IV are substituted and unsubstituted alkyl groups having 1 to 4 carbon atoms in the alkyl moiety, such as a methyl group, an ethyl group, a propyl group, etc.

$V_1$, $V_2$, $V_3$, $V_4$, $V_5$, and $V_6$ each represents a hydrogen atom, a halogen atom (e.g., fluorine atom, chlorine atom, bromine atom, iodine atom), a trifluoromethyl group, a cyano group, a carboxy group, an alkoxycarbonyl group preferably having 2–5 carbon atoms (e.g., methoxycarbonyl group, ethoxycarbonyl group, etc.), an aminosulfonyl group i.e. an unsubstituted or a substituted by, for example, one or two alkyl groups preferably having 1–4 carbon atoms (e.g., aminosulfonyl group, methylaminosulfonyl group, dimethylaminosulfonyl group, diethylaminosulfonyl group, etc.), and two substituted alkyl groups may constitute a heterocyclic ring containing at least one nitrogen atom or at least one nitrogen atom and at least one hetero atom other than nitrogen atom (e.g., oxygen atom) or an alkylsulfonyl group preferably having 1–4 carbon atoms (e.g., methylsulfonyl group, etc.).

$W_1$, $W_2$, $W_4$, $W_5$, $W_7$, $W_8$, $W_{11}$, $W_{12}$, $V_9$, and $V_{10}$ each represents a hydrogen atom, a halogen atom (e.g., fluorine atom, chlorine atom, bromine atom, iodine atom), an alkyl group preferably having 1–4 carbon atoms (e.g., methyl group, ethyl group, etc.), an alkoxy group preferably having 1–4 carbon atoms (e.g., methoxy group, ethoxy group etc.), a hydroxy group, an acyloxy group preferably having 2–5 carbon atoms (e.g., acetoxy group, etc.), or a phenyl group.

$X_1^{31}$, $X_2^-$, $X_3^-$, $X_4^-$ and $X_5^-$ each represents an acid anion. The acid anion is preferably such that it forms a salt which is able to dissolve in water or an organic solvent. Examples of the acid anions include chloride ion, bromide ion, iodide ion, methyl sulfate ion, ethyl sulfate ion, p-toluenesulfonate ion, etc.

When each of the sensitizing dyes shown by general formulae I to IV forms an intramolecular salt, n, $n_1$, $n_2$ and $n_3$ each is 0.

In the particularly preferred sensitizing dyes shown by general formulae I to IV, $V_3$, $V_4$ and $V_6$ each is a chlorine atom; $V_1$, $V_2$, and $V_5$ each is a chlorine atom, a trifluoromethyl group, or a cyano group; $W_1$, $W_4$, $W_7$, $W_{11}$, and $V_9$ each is a chlorine atom, a phenyl group, or a methoxy group; and R and $R_{15}$ each is an ethyl group.

The compound of general formula II may be treated with an acid having an acid anion such as those defined for $X_{1\text{-}5}^-$. By the treatment the proton of the acid is added to the carbon of the end of the trimethine chain of the compound and the acid anion is added to the compound in the same manner as $X_{1\text{-}5}^-$.

Z and $Z_1$ in general formulae V and VI each represents a non-metallic atomic group necessary for completing a heterocyclic nucleus which may be substituted with, for example, an alkyl group, an aryl group, halogen, nitro group, an alkoxy group, a carboxyl group, an alkoxycarbonyl group, an aralkyl group, cyano group, hydroxy group, and an alkyl moiety in these groups preferably has 1–8, more preferably 1–4 carbon atoms. Organic groups among these substituents may be further substituted, and a heterocyclic nucleus may be a condensed ring with a saturated hydrocarbon ring. Heterocyclic nuclei include a thiazole nucleus (e.g., thiazole, 4-methylthiazole, 4-phenylthiazole, 4,5-dimethylthiazole, 4,5-diphenylthiazole, etc.), a benzothiazole nucleus (e.g., benzothiazole, 4-chlorobenzothiazole, 5-chlorobenzothiazole, 6-chlorobenzothiazole, 7-chlorobenzothiazole, 5-nitrobenzothiazole, 6-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-methoxybenzothiazole, 6-methoxybenzothiazole, 5-ethoxybenzothiazole, 5-propoxybenzothiazole, 5-butoxybenzothiazole, 5-carboxybenzothiazole, 5-ethoxycarbonylbenzothiazole, 5-phenethylbenzothiazole, 5-fluorobenzothiazole, 5-chloro-6-methylbenzothiazole, 5-trifluoromethylbenzothiazole, 5,6-dimethylbenzothiazole, 5-hydroxy-6-methylbenzodthiazole, tetrahydrobenzothiazole, 4-phenylbenzothiazole, 5-phenylbenzothiazole, etc.), a naphthothiazole (e.g., naphtho[2,1-d]thiazole, naphto[1,2-d]thiazole, naphtho[2,3-d]thiazole, 5-methoxynaphtho[1,2-d]thiazole, 7-ethoxynaphtho[2,l-d]thiazole, 8-methoxynaphtho[2,1-d]thiazole, 5-methoxynaphtho[2,3-d]thiazole, etc.), a thiazoline nucleus (e.g., thiazoline, 4-methylthiazoline, 4-nitrothiazoline, etc.), an oxazole nucleus (e.g., oxazole, 4-methyloxazole, 4-nitroxazole, 5-methyloxazole, 4-phenyloxazole, 4,5-diphenyloxazole, 4-ethyloxazole, etc.), a benzoxazole nucleus (e.g., benzoxazole, 5-chlorobenzoxazole, 5-methylbenzoxazole, 5-bromobenzoxazole; 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, etc.), a naphthoxazole nucleus (e.g., naphtho[2, -d]oxazole, naphtho[,1,2-d]oxazole, naphtho[2,3-d]oxazole, 5-nitronaphtho[2,1-d]oxazole, etc.), an oxazoline nucleus (e.g., oxazoline, 4,4-dimethyloxazoline, etc.), a selenazole nucleus (e.g., selenazole, 4-methylselenazole, 4-nitroselenazole, 4-phenylselenazole, etc.), a selenazoline nucleus (e.g., selenazoline, 4-methylselenazoline, 4-phenylselenazoline, etc.), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, etc.), a naphthoselenazole nucleus (e.g., naphtho[2,1-d]selenazole, naphtho[1,2-d]selenazole, etc.), an indolenine nucleus (e.g. 3,3-dialkylindolenine such as 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine 3,3-dimethyl-5-methoxyindolenine, 3,3-dimethyl-5-methylindolenine, 3,3-dimethyl-5-chloroindolenine, etc.), an imidazole nucleus (e.g., 1-alkylimidazole, 1-alkyl-4-phenylimidazole, etc.), a benzimidazole nucleus (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-allyl-5,6- dichlorobenzimidazole, 1-allyl-5-chlorobenzimidazole, 1-arylimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole, etc.), a naphthoimidazoIe nucleus (e.g., 1-alkylnaphtho[1,2-d]imidazole, 1-arylnaphtho[1,2-d]imidazole, etc.) [the alkyl group substituted to the imidazole, the benzimidazole and the naphthoimidazole nuclei are preferably an alkyl group having 1 to 8 carbon atoms, e.g., an unsubstituted alkyl group such as methyl, ethyl, propyl, isopropyl, butyl, etc., and a hydroxyalkyl group such as 2-hydroxyethyl, 3-hydroxypropyl, etc., and the aryl group of the benzimidazole and the naphthoimidazole nuclei is phenyl, phenyl substituted by a halogen (e.g., chlorine), phenyl substituted by an alkyl (preferably having 1–4 carbon atoms, e.g., methyl), phenyl substituted by an alkoxy (preferably having 1–4 carbon atoms, e.g., methoxy), etc.; a pyrrolidine nucleus (e.g., 2-pyrrolidine, etc.)], a pyridine nucleus (e.g., pridine, 5-methyl-2-pyridine, 3-methyl-4-pyridine, etc.), a quinoline nucleus (e.g., quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro-1-isoquinoline, 3,4-dihydro-1-isoquinoline, 6-nitro-3-isoquinoline, etc.), or a tetrazole nucleus.

In the foregoing cases, it is preferred that each Z and $Z_1$ be a non-metallic atomic group necessary for completing the thiazole nucleus, the benzothiazole nucleus, the thiazoline nucleus, the benzoxazole nucleus, the naphthooxazole nucleus, the selenazole nucleus, the selenazoline nucleus, the benzoselenazole nucleus, the benzoimidazole nucleus, the pyrrolidine nucleus, the pyridine nucleus, or the tetrazole nucleus (these nuclei may be substituted).

$R_{20}$, $R_{21}$, $R_{22}$, and $R_{23}$ in general formulae V and VI each represents a hydrogen atom, an alkyl group, preferably having 1 to 18 carbon atoms, more preferably 1 to 8 carbon . atoms, such as methyl group, ethyl group, propyl group, isopropyl group, butyl group, hexyl group, dodecyl group, octadecyl group, etc.; a substituted alkyl group having 1–8 carbon atoms, preferably 1–4 carbon atoms in the alkyl group (e.g., an aralkyl group such as benzyl group, β-phenylethyl group, etc.; a hydroxyalkyl group such as 2-hydroxyethyl group, 3-hydroxypropyl group; a hydroxyalkoxy alkyl group having 1–4 carbon atoms in the alkoxy group, such as 2-hydroxyethoxyethyl group, etc.; a carboxyalkyl group such as 2-carboxyethyl group, 3-carboxypropyl group, 4-carboxybutyl group, etc.; a substituted or unsubstituted alkyl group having a sulfo group such as a sulfo alkyl group, e.g. 2-sulfoethyl group, 3-sulfopropyl group, 3-sulfobutyl group, and 4-sulfobutyl group; a sulfoalkoxy alkyl group having 1–4 carbon atoms in the alkoxy moiety, such as 2-3-sulfopropoxy)ethyl group, a hydroxy-sulfoalkyl group e.g. 2-hydroxy-3-sulfopropyl group, a sulfoalkoxy alkoxy alkyl group preferably having 1–4 carbon atoms in the alkoxy moiety, e.g. 3-sulfopropoxyethoxyethyl group, a sulfoaralkyl group having 6–10 carbon atoms in aryl moiety, e.g. sulfo phenethyl group, etc.; a sulfate alkyl group such as 3-sulfate propyl group, 4-sulfate butyl group, etc.), an aryl group (e.g., a substituted and unsubstituted phenyl group such as a phenyl group, a tolyl group, a methoxyphenyl group, a chlorophenyl group, and a naphthyl group, etc.), or an allyl group.

Y in general formulae V and VI represents a hydrogen atom, an alkyl group preferably having 1–4 carbon atoms and including substituted and unsubstituted alkyl groups (e.g., methyl group, ethyl group, propyl group and an aralkyl group preferably having 6–10 carbon atoms in the aryl moiety such as benzyl group, etc.), or an aryl group preferably having 6–10 carbon atoms (e.g., phenyl group, o-carboxyphenyl group, p-carboxyphenyl group, etc.)

Q and $Q_1$ in general formulae V and VI each represents a non-metallic atomic group necessary for completing a rhodanine nucleus, 2-thiooxazolizine-2,4-dione nucleus, 2-thioselenazolidine-2,4-dione nucleus, a barbituric acid or thiobarbituric acid nucleus (e.g., a barbitur nucleus or thiobarbitur nucleus having a 1-alkyl group such as 1-methyl, 1-ethyl, 1-propyl, 1-heptyl, etc.; a 1,3-dialkyl group such as 1,3-dimethyl, 1,3-diethyl, 1,3-dipropyl, 1,3-diisopropyl, 1,3-dicyclohexyl, 1,3-di(β-methoxyethyl, etc.; a 1,3-diaryl group such as 1,3-diphenyl, 1,3-di(p-chlorophenyl), 1,3-di(p-ethoxycarbonylphenyl), etc.; a 1-sulfoalkyl group such as 1-(2-sulfoethyl), 1-(3-sulfopropyl), 1-(4-sulfoheptyl), etc.; a 1,3-disulfoalkyl group such as 1,3-di(2-sulfoethyl), 1,3-di(3-sulfopropyl), 1,3-di(4-sulfocyclohexyl), etc.; a 1,3-di(-sulfoaryl) group such as 1,3-di(4-sulfophenyl), etc.; or a 1-sulfoaryl group (e.g., 1-(4-sulfophenyl), etc.), or a thiohydantoin nucleus (the substituent at the 1-position has the same significance as the substituent at the 3-position ($R_{21}$ or $R_{23}$) but may be same as or different from the latter). The alkyl group in Q and $Q_1$ preferably have 1–6 carbon atoms.

In the present invention a sulfo group and a carboxy group include $-SO_3^-$, $-SO_3H$ and $-SO_3M$ and $-COO^-$, $-COOH$ and COOM, respectively (M: for example, alkali metal such as Na and K and quaternary organic ammonium ion group such as $H^+N(CH_3)_3$).

The silver halide photographic emulsion of this invention is preferably the internal latent image type silver halide photographic emulsion capable of forming a direct positive image by performing a surface development in the presence of a fogging agent.

Practical examples of the sensitizing dye shown by general formulae I, II, III and IV and compound shown by general formulae V and VI are as follows. However, the invention is not limited to them.

I-1

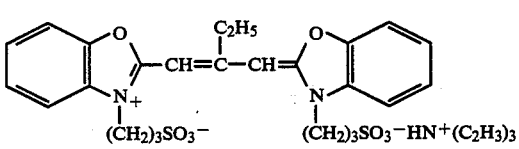

I-2

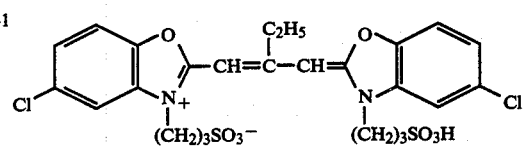

I-3

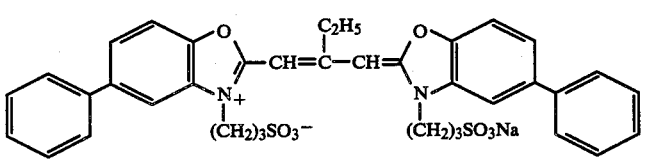

I-4

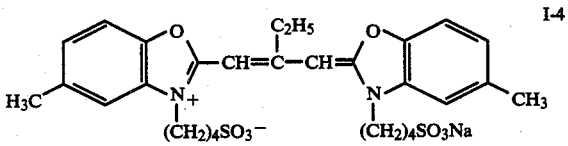

I-5

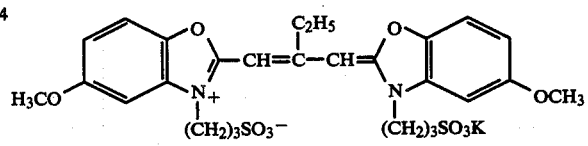

-continued
I-6
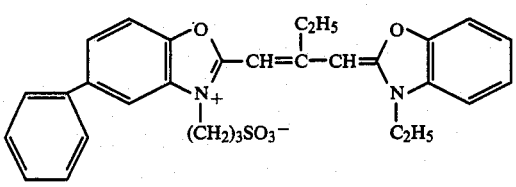
I-7
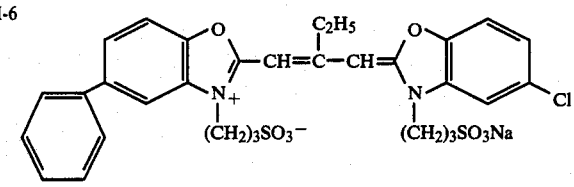
I-8
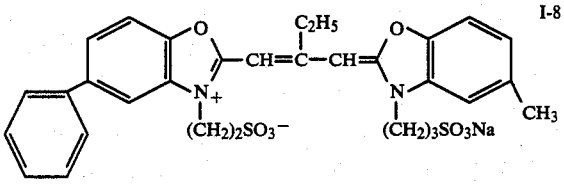
I-9
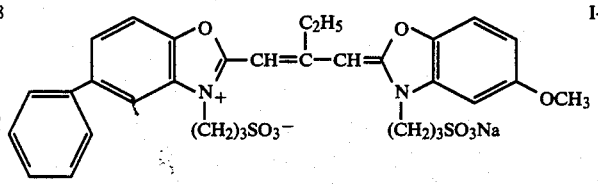
I-10
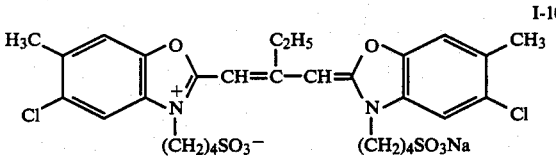
I-11
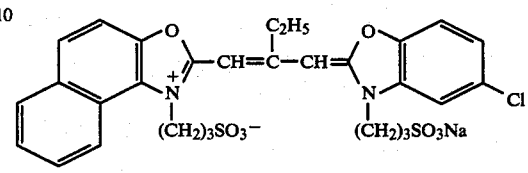
II-1
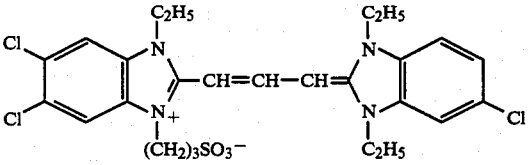
II-2
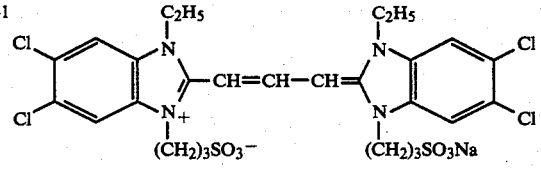
II-3
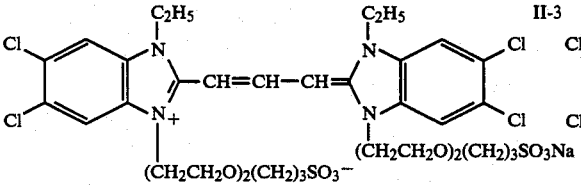
II-4
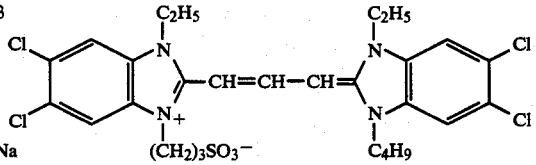
II-5
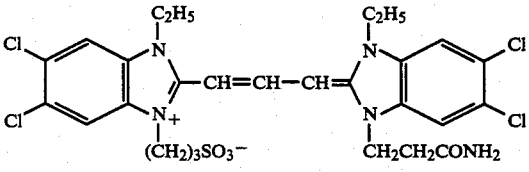
II-6
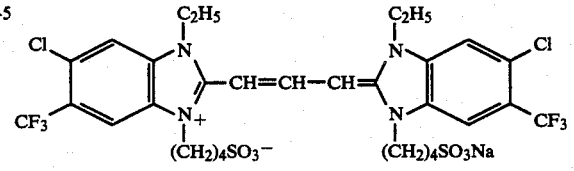
II-7
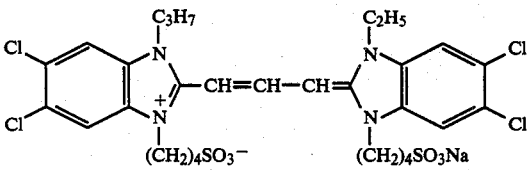
II-8
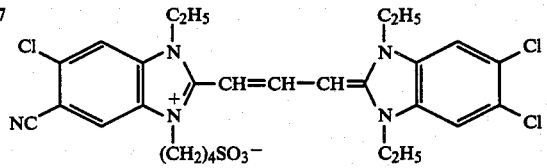
II-9
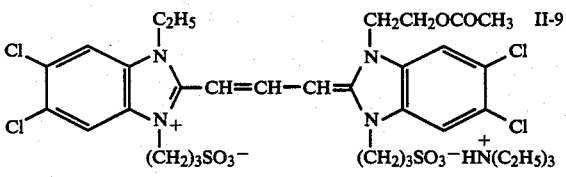
II-10
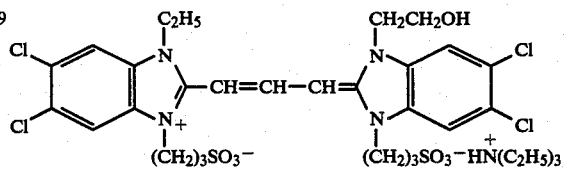
II-11
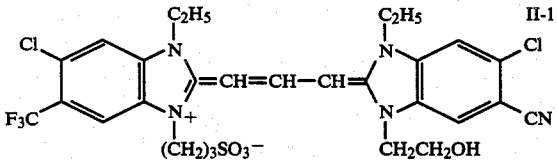
II-12
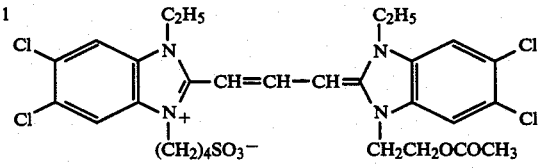

-continued
II-13
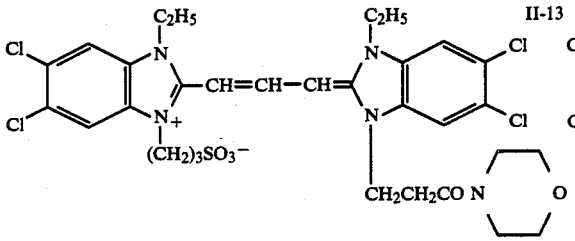
II-14
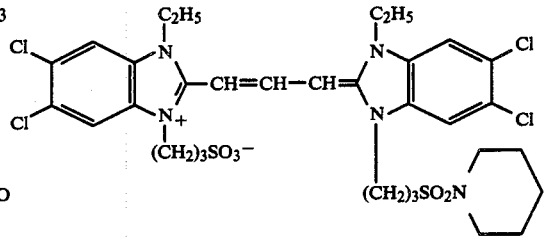
II-15
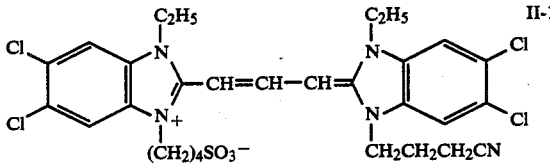
II-16
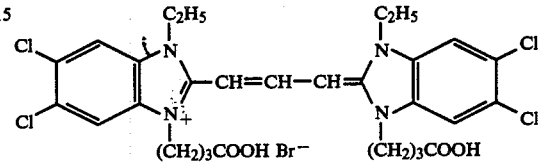
II-17
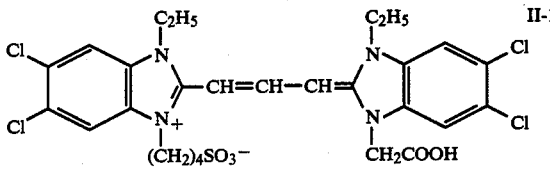
II-19
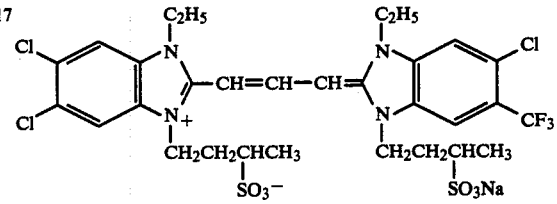
II-20
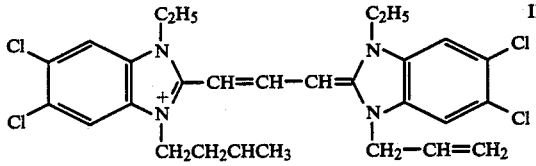
II-21
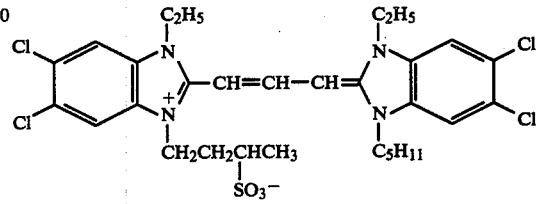
III-1
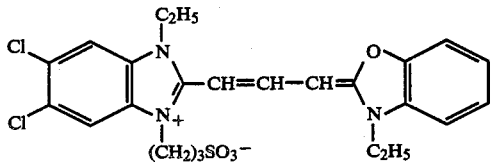
III-2
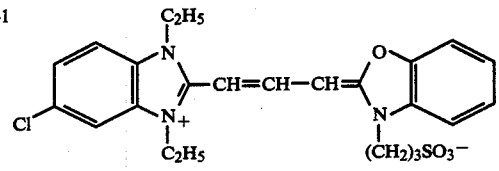
III-3
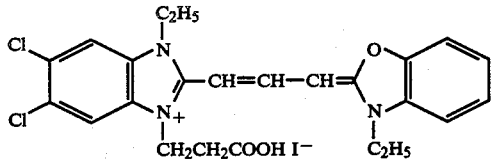
III-4
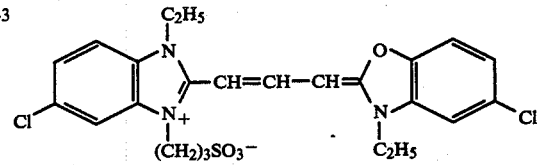
III-5
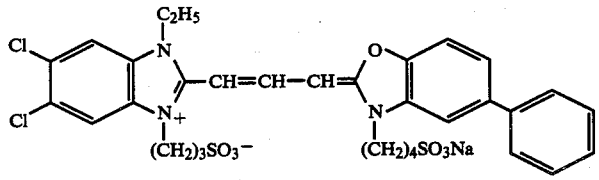
III-6
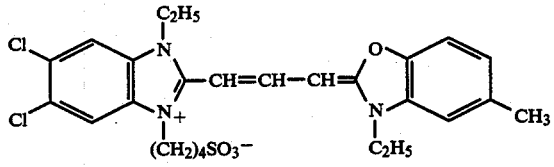
III-7
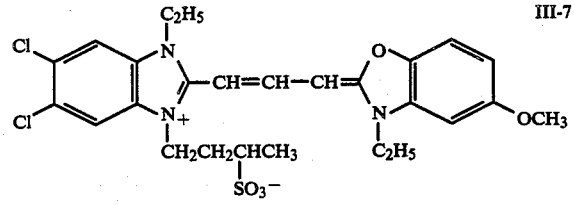
IV-1
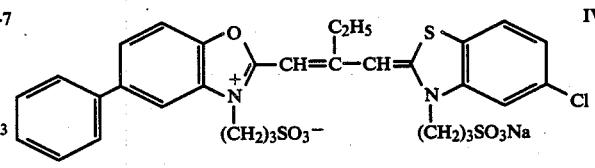

-continued
IV-2
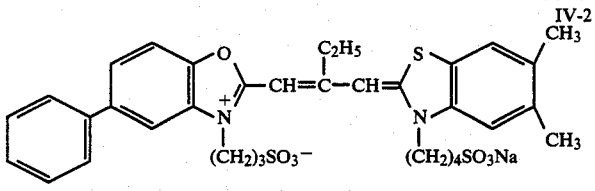
IV-3
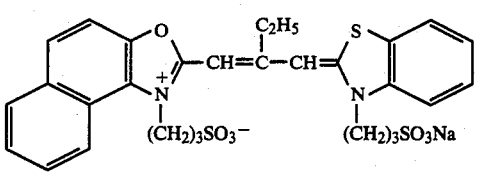
IV-4
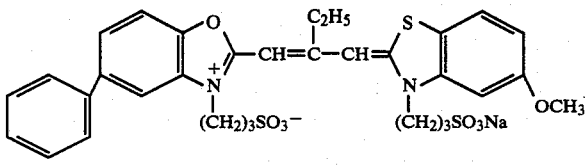
IV-5
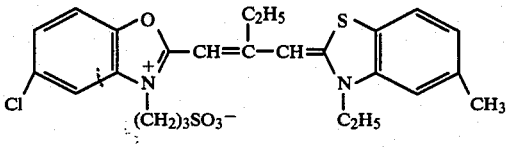
IV-6
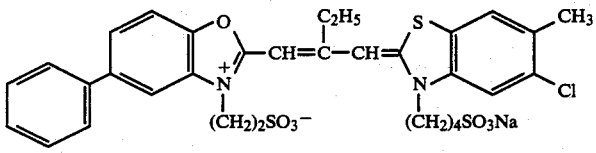
IV-7
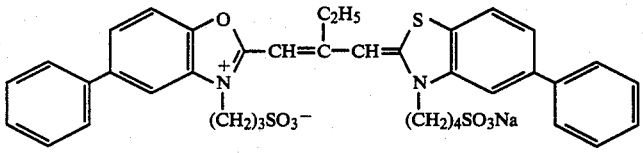
IV-8
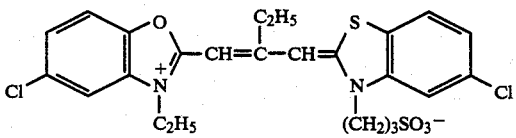
IV-9
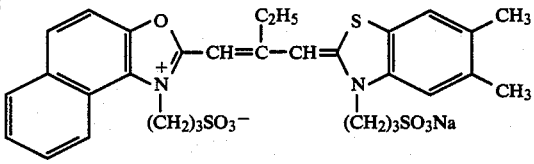
IV-10
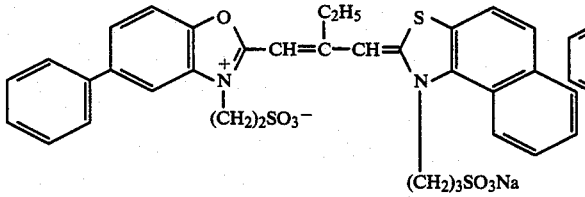
IV-11
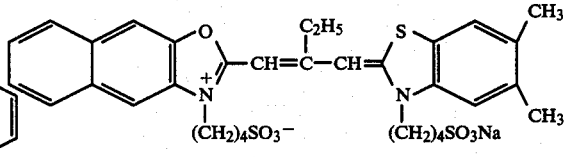
IV-12
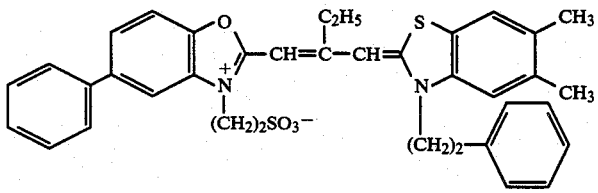
IV-13
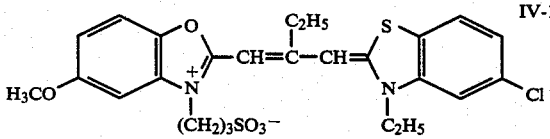
IV-14
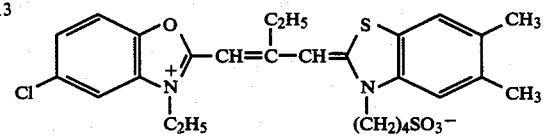
IV-15
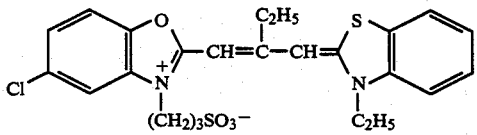
IV-16
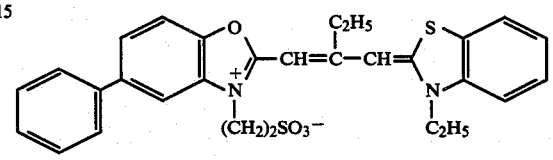

-continued
IV-17
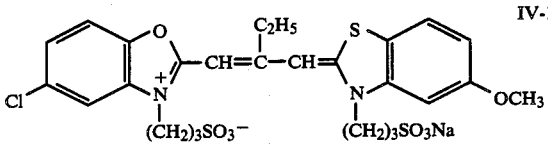
V-1
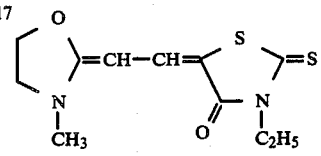
V-2
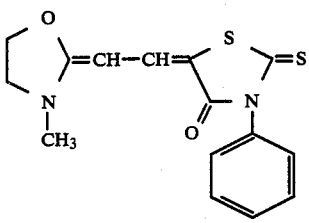
V-3
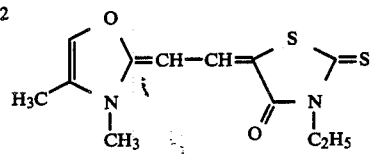
V-4
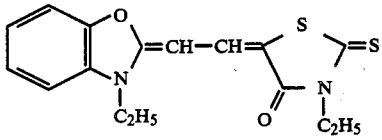
V-5
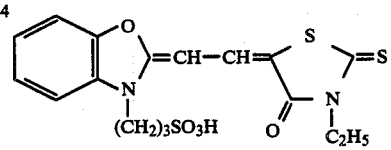
V-6
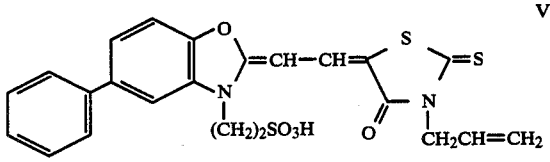
V-7
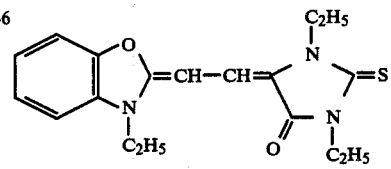
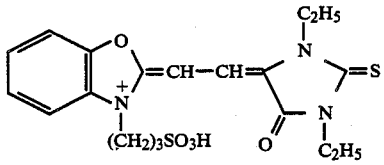
V-8
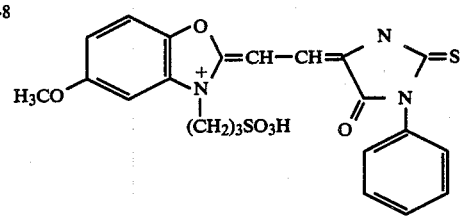
V-9
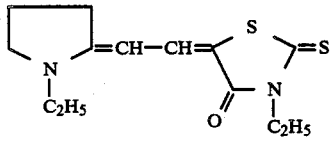
V-10
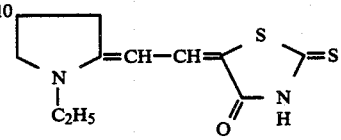
V-11
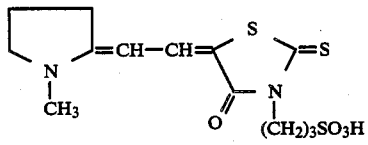
V-12
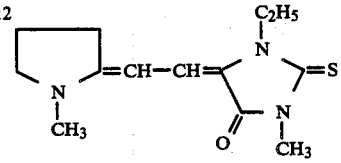
V-13
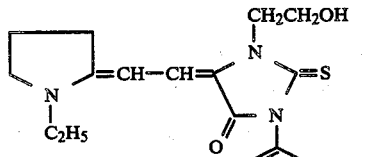
V-14
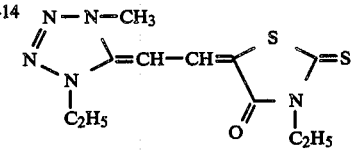
V-15

-continued
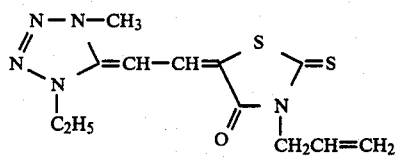
V-16
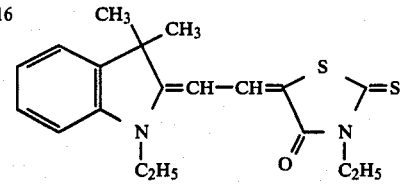
V-17
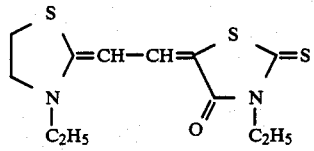
V-18
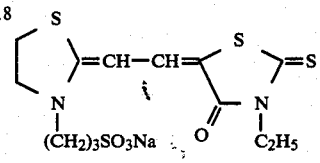
V-19
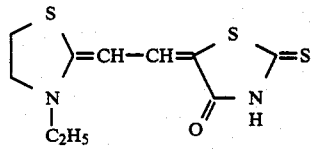
V-20
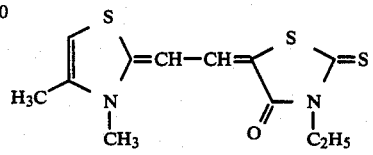
V-21
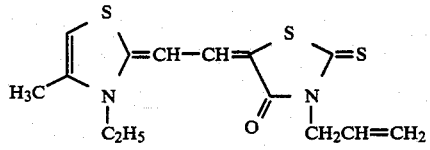
V-22
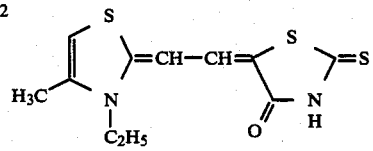
V-23
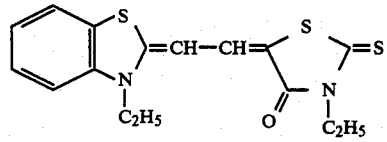
V-24
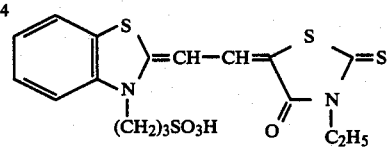
V-25
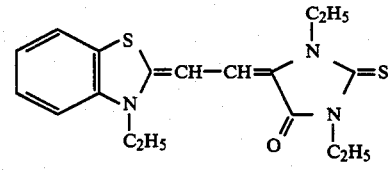
V-26
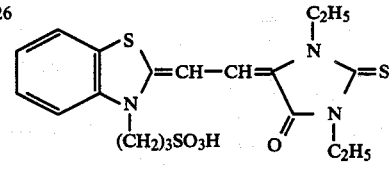
V-27
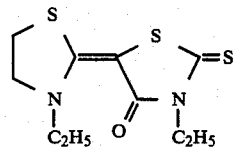
VI-1
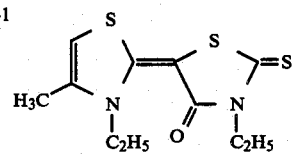
VI-2
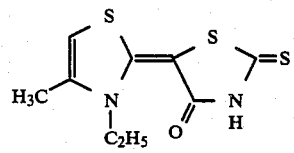
VI-3
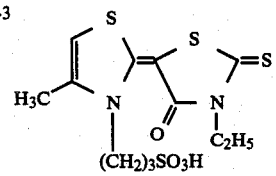
VI-4
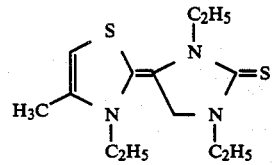
VI-5
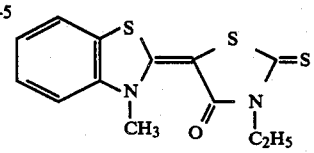
VI-6

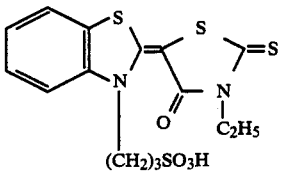

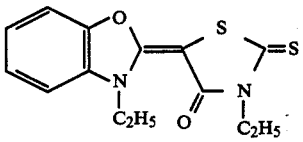

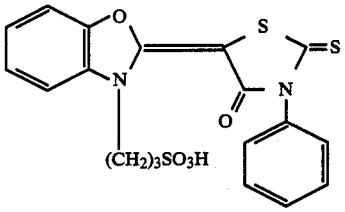

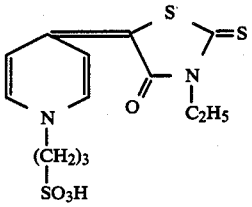

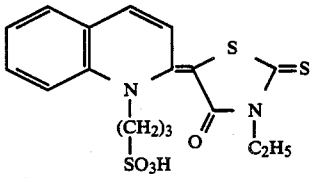

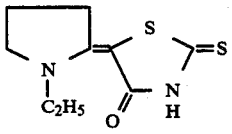

-continued

VI-7

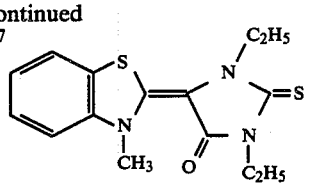

VI-8

VI-9

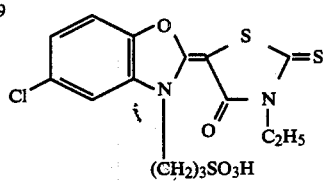

VI-10

VI-11

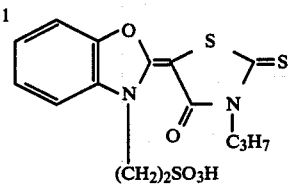

VI-12

VI-13

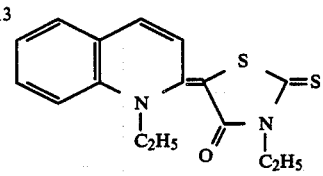

VI-14

VI-15

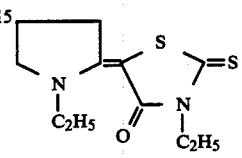

VI-16

VI-17

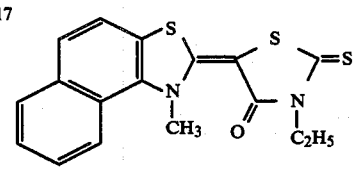

VI-18

The sensitizing dyes shown by foregoing general formulae I, II, III, and IV and the compounds shown by foregoing general formulae V and VI are described in U.S. Pat. Nos. 2,852,385; 2,694,638; 3,615,635; 2,912,329; 3,364,031; 3,397,060; and 3,506,443; British Pat. No. 1,339,833, etc., and they can be easily prepared by referring to the processes or referring to processes similar to the processes described in the above-mentioned patents and F. M. Hamer, "The Cyanine Dyes and Related Compounds", International Publishers, New York (1964).

The sensitizing dyes used in this invention are used at a concentration similar to that in the case of using for ordinary negative silver halide emulsions. In particular, it is profitable to use the sensitizing dye at a dye concentration of an extent of substantially not causing desensitization of a specific sensitivity of a silver halide emulsion. It is preferred to use the sensitizing dye at a concentration of about $1.0\times10^{-5}$ to about $5\times10^{-4}$ mole, particularly about $4\times10^{-5}$ to $2\times10^{-4}$ mole per mole of silver halide.

The optimum concentration of the sensitizing dye can be determined according to a known method, i.e., by a method of splitting into plural portions, incorporating the sensitizing dye in each portion of the silver halide emulsion at each different concentration, and measuring the spectral sensitivity of each portion.

The sensitizing dyes can be added to silver halide emulsions in a manner well known in this field of art.

That is, the sensitizing dye can be directly dispersed in a silver halide emulsion or is first dissolved in a water-miscible solvent such as pyridine, methanol, ethanol, methyl cellosolve, acetone or a mixture of them, diluted, as the case may be, with water, or dissolved in water and is added to a silver halide emulsion as the solution thereof. Also, a ultrasonic vibration may be applied in the case of dissolving the sensitizing dye. Other methods as described in, for example, Japanese Patent Publication Nos. 8231/'70; 23,389/'69; 27,555/'69; and 22948/'69; West German Patent Application (OLS) No. 1,947,935; and U.S Pat. Nos. 3,485,634; 3,342,605; 2,912,313, etc., can be used in this invention.

If necessary, the sensitizing dyes may be dissolved separately in proper solvents and the solutions may be added separately to a silver halide emulsion. Or, further, the sensitizing dyes may be dissolved in solvents having a same composition or in different solvents and the solutions may be added to a silver halide emulsion as a mixture of them.

The compound shown by foregoing general formula V or VI may be added to a silver halide emulsion in the same manner as the sensitizing dye.

The addition amount of the compound shown in general formula V and/or VI used in this invention depends upon the desired effect of this invention but is usually about $1.0\times10^{-5}$ to about $5\times10^{-4}$ mole, preferably about $4\times10^{-5}$ to about $2\times10^{-4}$ mole per mole of silver halide. The proper molar ratio of the amount of the compound to the sensitizing dye can be determined by testing using a conventional method. The ratio is usually 1/10 to 10.

Furthermore, at least one of the sensitizing dyes shown by following general formulae VII and VIII may be added to the silver halide emulsion containing the aforesaid sensitizing dye and compound according to this invention.

Formula VII

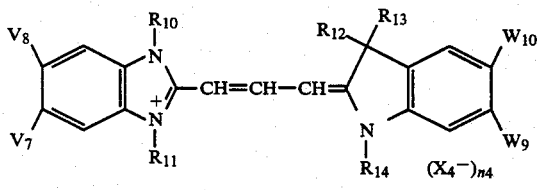

wherein $V_7$, $V_8$, $R_{10}$, and $R_{11}$ each has the same significance as $V_1$, $V_3$, $R_3$, and $R_5$, respectively, in general formula II; $R_{12}$ and $R_{13}$ each represents an alkyl group; $R_{14}$ represents the same groups as defined for $R_3$; $W_9$ and $W_{10}$ each represents a hydrogen atom, a halogen atom, an alkyl group, an alkoxy group, a hydroxy group, an acyloxy group, or a phenyl group; $X_4$ represents an acid anion; $n_4$ represents 0 or 1, and in $W_9$ and $W_{10}$ each alkyl moiety preferably has 1–4 carbon atoms.

Formula VIII

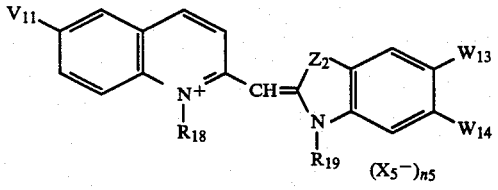

wherein $V_{11}$ represents a hydrogen atom, a halogen atom, an alkyl group, preferably having 1–4 carbon atoms, a hydroxy group, an acyloxy group preferably having 2–5 carbon atoms, or a phenyl group; $Z_2$ represents an oxygen atom, a sulfur atom, a selenium atom, or —CH=CH—; $W_{13}$ and $W_{14}$ each represents a hydrogen atom, a halogen atom, an alkyl group, an alkoxy group, a hydroxy group, an acyloxy group, or a phenyl group and each alkyl moiety in $W_{13}$ and $W_{14}$ preferably has 1–4 carbon atoms; $R_{18}$ and $R_{19}$ each represents an alkyl group or a substituted alkyl group as defined for $R_3$, $X_5$ represents an acid anion; and $n_5$ represents 0 or 1.

Examples of the sensitizing dyes shown by general formulae VII and VIII are shown below but the invention is not limited to them.

VII-1

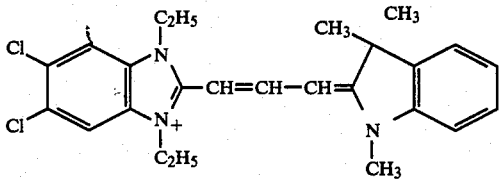

VII-2

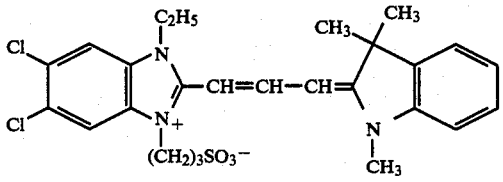

VII-3

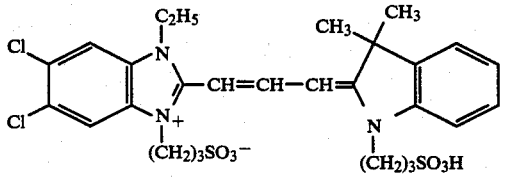

VII-4

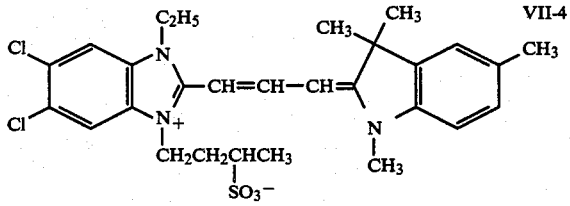

VII-5

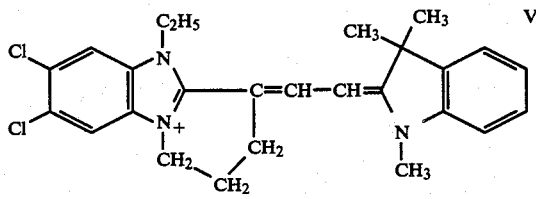

VII-6

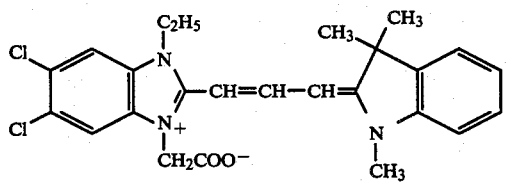

VII-7

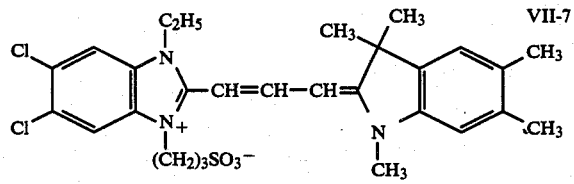

-continued
VII-8
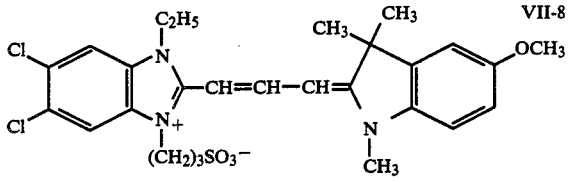
VII-9
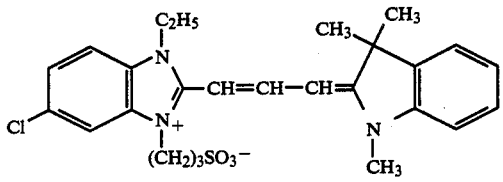
VII-10
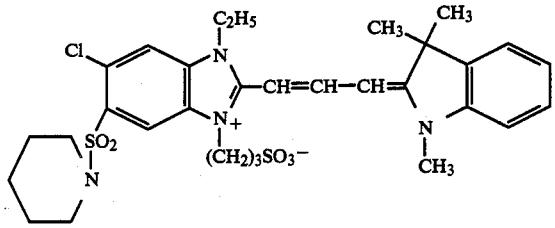
VIII-1
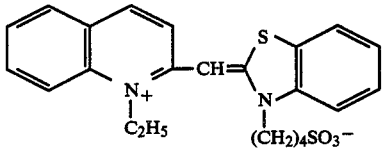
VIII-2
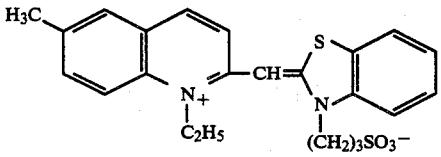
VIII-3
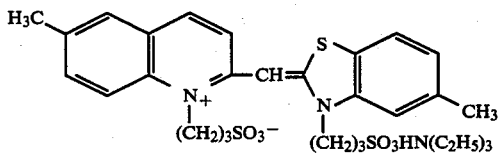
VIII-4
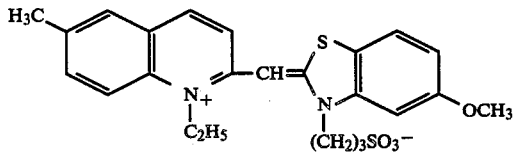
VIII-5
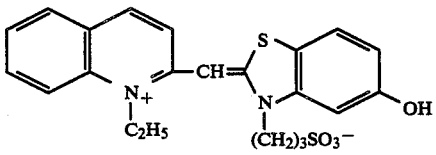
-continued
VIII-6
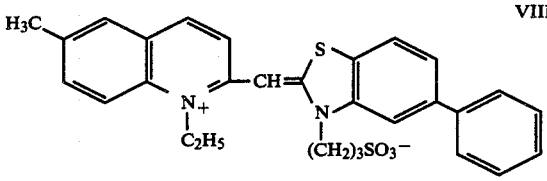
VIII-7
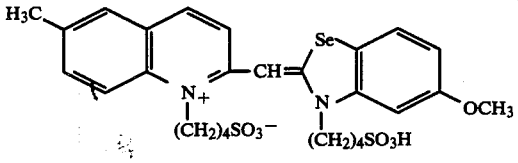
VIII-8
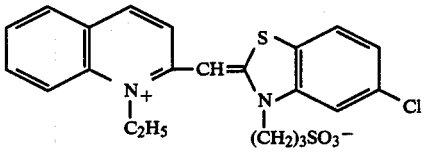
VIII-9
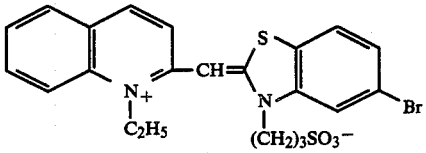
VIII-10
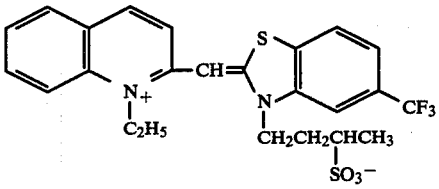
VIII-11
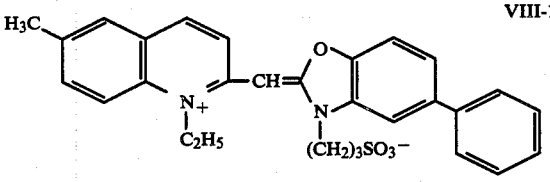
VIII-12
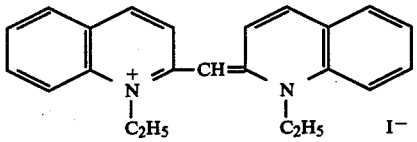
VIII-13
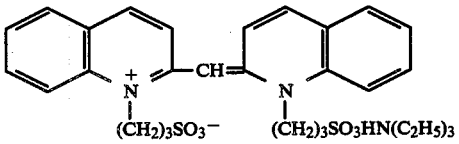
VIII-14
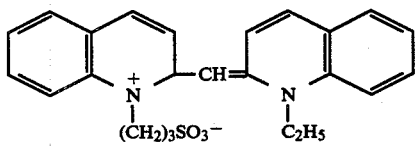

-continued

VIII-15

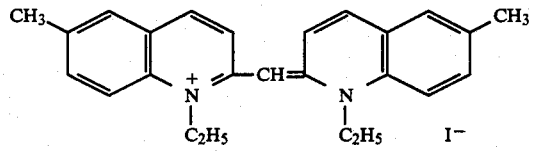

The sensitizing dye shown by general formula VII and/or VIII is preferably used at a concentration of about $1.0\times10^{-5}$ to about $5\times10^{-4}$ mole, particularly about $4\times10^{-5}$ to about $2\times10^{-4}$ mole per mole of silver halide. The proper molar ratio of the amount of the sensitizing dye shown by general formulae VII and/or VIII to the amount of the sensitizing dye shown by general formulae I, II, III and/or IV can be determined by testing using a conventional method. The proper ratio is usually 1/10 to 10.

The preferred photographic material of the present invention is that which has an internal latent image type silver halide emulsion layer contains (1) at least one of the sensitizing dyes represented by general formula I or III and at least one of the compounds represented by general formula V or VI, (2) at least one of the sensitizing dyes represented by general formula II or IV and at least one of the compounds represented by general formula V or VI, or (3) at least one of the sensitizing dyes represented by general formula I or III, at least one of the sensitizing dyes represented by general formula II or IV, and at least one of the compounds represented by general formula V or VI.

The silver halide photographic emulsion of this invention may further contain a dye having no spectral sensitizing action by itself or a material which does not substantially absorb visible light and shows a super sensitization together with the foregoing sensitizing dye or dyes. Examples of such materials are aminostilbene compounds substituted by nitrogen-containing heterocyclic ring group (as described in, e.g., U.S. Pat. Nos. 2,933,390 and 3,635,721), aromatic organic formaldehyde consensation products (as described in, for example, U.S. Pat. No. 3,743,510), cadmium salts, azaindene compounds, etc. The combinations described in U.S. Pat. Nos. 3,615,613; 3,615,641; 3,617,295; and 3,635,721 are particularly advantageous.

For other silver halide emulsion layers than the silver halide photographic emulsion layers of this invention, the sensitizing dyes described in, for example, Japanese Patent Application (OPI) Nos. 71,829/'78; 148,419/'76; 9,522/'78, etc., solely or as a combination of them may be used.

Examples of the silver halide used for the silver halide photographic emulsions of this invention are silver bromide, silver iodide, silver chloride, silver chlorobromide, silver bromoiodide, silver chlorobromo-iodide, etc. The preferred silver halide emulsion in this invention contains at least 50 mole % silver bromide and the most preferred silver halide emulsion in this invention is a silver bromide emulsion and a silver bromoiodide emulsion containing, in particular, not more than 10 mole % silver iodide.

An internal latent image type silver halide emulsion is a silver halide emulsion mainly forming a latent image in the inside of silver halide grains and is discriminated from silver halide grains mainly forming a latent image on the surface of the silver halide grains. Such internal latent images are disclosed by Davey et al. in U.S. Pat. No. 2,592,250, etc. The internal latent image type silver halide emulsion can be more clearly defined by the fact that the maximum density obtained by developing with an "internal" developer is higher than the maximum density obtained by developing a "surface" developer.

That is, the maximum density obtained by coating the internal latent image type silver halide emulsion suitable for this invention on a transparent support, exposing the photosensitive material thus formed for a definite time of 0.01 sec. to 1 sec., developing the material in an internal type developer having following developer composition A at 20° C. for 3 minutes, and measuring the maximum density by an ordinary photographic density measuring method is at least 5 times higher than the maximum density obtained in the case of developing the photosensitive material prepared as above and exposed by the same manner as above in a surface developer having following developer composition B at 20° C. for 4 minutes. In the preferred internal latent image type silver halide emulsion, the maximum density obtained by developing in developer A is over 10 times the maximum density obtained by developing in developer B.

The useful internal latent image type silver halide emulsions suitable for the objects of this invention are described in foregoing U.S. Pat. No. 2,592,250 as well as West German Patent Application (OLS) Nos. 2,308,239 and 2,416,814; British Pat. No. 1,027,146; U.S. Pat. Nos. 3,206,313; 3,511,662; 3,447,927; 3,737,313; 3,271,157; 3,317,322; 3,761,266; 3,761,267; 3,761,276; 3,850,637; 3,923,513, 4,395,478, Japanese Patent Application (OPI) 108532/83, etc., although the silvcr halide emulsions used in this invention are not limited to them.

| | |
|---|---|
| Developer A: | |
| Hydroquinone | 15 g |
| Monomethyl-p-aminophenol sesquisulfate | 15 g |
| Sodium sulfite | 50 g |
| Potassium bromide | 10 g |
| Sodium hydroxide | 25 g |
| Sodium thiosulfate | 20 g |
| Water to make | 1 liter. |
| Developer B: | |
| p-Oxyphenylglycine | 10 g |
| Sodium carbonate | 100 g |
| Water to make | 1 liter |

The invention is useful for an internal latent image type silver halide emulsion used for a photographic process of obtaining a direct positive image by surface developing the image-exposed silver halide emulsion layer in the presence of a fogging agent.

However, the effect of this invention is also obtained even in a process of obtaining a direct positive image by applying overall exposure (by flash light, etc.), after the imagewise exposure of the internal latent image type silver halide emulsion layer, during developing the emulsion layer in the surface developer.

The fogging agent used in this invention is a material which acts during development or pre-bath processing to form preferentially surface development nuclei to a silver halide emulsion having no internal latent image (i.e., internal development nuclei), whereby the silver halide grains become developable by a surface developer and it is considered that a fogging agent having almost no action of newly forming surface development nuclei to silver halide grains already having internal latent images (internal development nuclei) is preferred.

Examples of the fogging agent used in this invention are hydrazines described in U.S. Pat. Nos. 2,588,982 and 2,568,785, hydrazide and hydrazones described in U.S. Pat. No. 3,227,552, and hydrazone quaternary salts described in U.S. Pat. No. 3,615,615, etc., and they may be used as a combination thereof.

Preferred examples of the fogging agent used in this invention are the hydrazines and the hydrazone quaternary salts.

The amount of the fogging agent used can be adjusted over a wide range according to desired result. When the fogging agent is incorporated in a photographic material, the concentration of the fogging agent is 50 to 15,000 mg per mole of Ag, preferably 300 to 6,000 mg per mole of Ag. On the other hand, when the fogging agent is incorporated in a developer, the amount of the fogging agent is about 0.05 to 5 g, preferably 0.1 g to 1 g per liter of the developer. When the fogging agent is incorporated in a photographic layer of a photographic material, it is effective for the purpose of it to render the fogging agent non-diffusible.

The silver halide emulsion of this invention may further contain a dye image-forming coupler. Or, the silver halide emulsion layer of this invention may be developed in a developer containing a dye image-forming coupler. When the coupler is incorporated in the silver halide emulsion of this invention, it can be incorporated by a known method. For example, the methods described in U.S. Pat. Nos. 1,055,155; 1,102,028; 2,186,849; 2,322,027; and 2,801,171.

In this invention, a developing agent such as a polyhydroxybenzene, an aminophenol, a 3-pyrazolidone, etc., may be incorporated in the silver halide emulsion or in a photographic layer other than a silver halide layer in the photographic material. When the photographic material is a film unit type a developing agent may be incorporated in a rupturable container containing a processing composition. Also, in this invention, the silver halide photographic emulsions may be non-hardened ones or may contain a tanning developing agent such as hydroquinone, catechol, etc.

The internal latent image type silver halide photographic emulsions of this invention can be used for various uses but are particularly advantageously used as silver halide emulsions for direct positive type photographic materials, silver halide emulsions for multilayer reversal color photographic materials, and silver halide emulsions for multilayer color diffusion transfer process.

The silver halide photographic emulsion of this invention can be also used for obtaining a desired transferred image on an image-receiving layer after proper development processing by associating with a diffusion transfer dye image-providing material capable of releasing a diffusible dye corresponding to the development of the silver halide emulsion. As such diffusion transfer dye image-providing materials, many materials are known as disclosed in, for example, U.S. Pat. Nos. 3,227,551, 3,227,554; 3,443,939; 3,443,940; 3,658,524; 3,698,897; 3,725,062; 3,728,113; 3,751,406; 3,929,760; 3,931,144; 3,932,381; 3,928,312; 4,013,633; 3,932,380; 3,954,476; 3,942,987; and 4,013,635; U.S. Patent Publication (USB) No. 351,673; British Pat. Nos. 840,731; 904,364; and 1,038,331; West German Patent Application (OLS) Nos. 1,930,215; 2,214,381; 2,228,361; 2,317,134; and 2,402,900; French Pat. No. 2,284,140; Japanese Patent Application (OPI) Nos. 113,624/'76 (corresponding to U.S. Pat. 4,055,428) and 104,343/'76; and Japanese Patent Application Nos. 64,533;'77; 58,318/'77, etc. In these materials, dye image-providing materials of the type that the materials are originally non-diffusible but are cleaved after causing the oxidation reduction reaction with the oxidation product of a developing agent to release diffusible dyes (hereinafter, are referred to as DRR compounds) are preferred.

Preferred DRR compounds used together with the silver halide photographic emulsions of this invention are the DRR compound having an o-hydroxyarylsulfamoyl group as described in foregoing Japanese Patent Application (OPI) No. 113 624/'76 and the DRR compound having a redox mother nucleus as described in Japanese Patent Application (OPI) No. 149,328/'78.

Practical examples of the DRR compounds are, in addition to those described in the foregoing patent specifications or specifications of the patent applications, such magenta dye image-forming materials as 1-hydroxy-2-tetramethylenesulfamoyl-4-[3'-methyl-4'-(2''-hydroxy-4''-methyl-5''-hexadecyloxyphenylsulfamoyl)-phenylazo]-naphthalene, such yellow dye image-forming materials as 1-phenyl-3-cyano-4-[3'-[2''-hydroxy-4''-methyl-5''-2''', 4'''-di-t-pentylphenoxyacetamino)-phenylsulfamoyl]phenylazo-5-pyrazolone.

For developing the photographic materials containing the silver halide photographic emulsions of this invention, various known developing agents can be used. That is, there are polyhydroxybenzenes such as hydroquinone, 2-chlorohydroquinone, 2-methylhydroquinone, catechol, pyrogallol, etc.; aminophenols such as p-aminophenol, N-methyl-p-aminophenol, 2,4-diaminophenol, etc.; 3-pyrazolidone such as 1-phenyl-3-pyrazolidone, 4,4-dimethyl-1-phenyl-3-pyrazolidone, 5,5-dimethyl-1-phenyl-3-pyrazolidone, etc.; and ascorbic acids. They can be used solely or as a combination of them. Also, for obtaining a dye image in the presence of a dye-forming coupler, an aromatic primary amine developing agent, preferably a p-phenylenediamine series developing agent can be used. Practical examples of the developing agent are 4-amino-3-methyl-N,N-diethylaniline hydrochloride, N,N-diethyl-p-phenylenediamine, 3-methyl-4-amino-N-ethyl-N-$\beta$(methanesulfoamido)ethylaniline, 3-methyl-4-amino-N-ethyl-N-($\beta$-sulfoethyl-)aniline, 3-ethoxy-4-amino-N-ethyl-N-($\beta$-sulfoethyl)aniline, 4-amino-N-ethyl-N-($\beta$-hydroxyethyl)aniline, and the like. Such a developing agent may be incorporated in an alkaline processing composition (processing element) or may be incorporated in a proper layer of a photosensitive element.

In the case of using the DRR compound in this invention, any silver halide developing agent which can cross oxidize the DRR compound can be used.

The developer used in this invention may contain sodium sulfite, potassium sulfite, ascorbic acid, reductions (e.g., piperidinohexose reduction, etc.), etc., as a preservative.

The photographic material containing the silver halide photographic emulsions of this invention can provide direct positive images by developing using a surface deverloper. The development by the surface developer is induced substantially by a latent image or fogging nucleus existing at the surface of silver halide grains. It is preferred that the developer does not contain a silver halide solvent but if the internal latent image does not substantially contribute until the development by the surface development center of silver halide grains is finished, the developer may contain a silver halide solvent (e.g. a sufite) to some extent.

The developer may also contain sodium hydroxide, potassium hydroxide, sodium carbonate, potassium carbonate, trisodium phosphate, sodium metaborate, etc., as an alkalifying agent and a buffer. The content of these agents is selected so that the pH of the developer becomes 10 to 13, preferably 11 to 12.5

The developer may also contain a color development accelerator such as benzyl alcohol, etc. Also, it is advantageous that the developer contains a benzimidazole such as 5-nitrobenzimidazole, etc.; a benztriazole such as benztriazole, 5-methyl-benztriazole, etc., which are usually used as an antifiggant, for further reducing the minimum density of the direct positive images.

The photographic material containing the silver halide photographic emulsions of this invention can be processed by a viscous developer.

The viscous developer is a viscous composition containing processing compositions necessary for developing silver halide emulsions and forming diffusion transfer dye images. The solvent is mainly water and may contain a hydrophilic solvent such as methanol, methyl cellosolve, etc. The processing composition contains an alkali in an amount sufficient for maintaining the pH necessary for causing the development of silver halide emulsion layers and for neutralizing the acids (e.g., a hydrohalogenic acid such as hydrobromic acid, etc., and a carboxylic acid such as acetic acid, etc.) formed during the development and various steps of forming dye images.

As the alkali, hydroxides, salts (such as phosphates and carbonates) of alkali metal and alkaline earth metal hydroxy organic ammonium compounds or amines such as lithium hydroxide, sodium hydroxide, potassium hydroxide, calcium hydroxide, tetramethyl-ammonium hydroxide, sodium carbonate, trisodium phosphate, diethylamine, etc., are used. In this case, it is preferred that the processing composition contains a caustic alkali at a concentration which provide a pH higher than about 12, particularly higher than 14 at room temperature. More preferably, the processing composition contains a hydrophilic polymer such as a high molecular weight polyvinyl alcohol, hydroxyethyl cellulose, sodium carboxymethyl cellulose, etc. Such a polymer is preferably used in such a manner that the viscosity of the processing composition becomes higher than 1 poise, preferably about 500 to about 1,000 poises at room temperature.

It is particularly advantageous in the case of a mono sheet type film unit that the processing composition further contains a light-absorbing material such as $TiO_2$, carbon black, a pH indicating dye, etc., for preventing the silver halide emulsion layers from being fogged by external light during processing and after processing and also a desensitizer as described in U.S. Pat. No. 3,579,333. Moreover, the processing composition may contain a development inhibitor such as benzotriazole, etc.

It is preferred that the foregoing processing composition is contained in a rupturable container as described in, for example, U.S. Pat. Nos. 2,543,181; 2,643,886; 2,653,732; 2,723,051; 3,056,491; 3,056,492; 3,152,515, etc.

When the photographic material containing the silver halide photographic emulsions of this invention for diffusion transfer photographic process, it is preferred that the photographic material be in a form of a film unit. The photographic unit, that is a film unit which can be processed by passing the film unit between a pair of jaxtaposed pressing members is fundamentally composed of the following three elements:

(1) photosensitive element containing the silver halide photographic emulsions of this invention, (2) image-receiving element, and (3) processing element: having a means, such as a rupturable container, for releasing the alkaline processing composition in the inside of the film unit and containing a silver halide solvent.

A preferred embodiment of the photographic film unit is a unitary type of the aforesaid elements as disclosed in Belgian Pat. No. 757,959. According to the embodiment, an image-receiving layer, a substantially opaque light-reflecting layer (e.g., a $TiO_2$-containing layer and a carbon black-containing layer), and a photosensitive element composed of a single or plural silver halide photographic emulsion layers associated with DRR compounds are coated, in succession, on a transparent support and further a transparent cover sheet is disposed thereon in a face-to-face relationship. A rupturable container containing an alkaline processing composition containing an opacifying agent (e.g., carbon black) is disposed adjacent to the upermost layer of the photosensitive element and the transparent cover sheet.

The film unit is image-exposed through the transparent cover in a camera and in the case of withdrawing the film unit from the camera, the container is ruptured by means of pressing members to uniformly spread the processing composition (containing an opacifying agent) between the protective layer of the photosensitive element and the cover sheet, whereby the film unit is shaded and the development proceeds. It is preferred that the cover sheet comprises a support which is coated with a neutralizing layer and, if necessary, a neutralization speed controlling layer (timing layer), in this order.

Also, other useful unitary film units using the DRR compounds or diffusible dye-releasing couplers are described in U.S. Pat. Nos. 3,415,644; 3,415,645; 3,415,646; 3,647,487; and 3,635,707; West German Patent Application (OLS) No. 2,426,980, etc.

For the photographic materials containing the direct positive silver halide photographic emulsions of this invention, various kinds of colloids can be used as a vehicle or a binder.

Examples of the satisfactory colloids used for the purpose are hydrophilic colloids generally used in the field of photography, for example, polysaccharides such as gelatin, colloidal albumin, dextran, gum arabic, etc.; cellulose derivatives such as hydroxyethyl cellulose, etc.; synthetic resins such as polyvinyl compounds including polyvinyl alcohol derivatives, acrylamide polymer etc. The foregoing hydrophilic colloid may contain a hydrophobic colloid such as a dispersed polymeric vinyl compound for improving the dimensional stability of the photographic materials. Proper examples of the hydrophobic colloid are the water-insoluble polymers of alkyl acrylate, alkyl methacrylate, acrylic acid, sulfoalkyl acrylate, sulfoalkyl methacrylate, etc.

The silver halide photographic emulsions of this invention may be coated on various supports together with other photographic compositions to provide photographic elements. The silver halide photographic emulsions may be coated on one surface or both surfaces of a support, preferably a transparent and/or flexible support. Typical examples of the support are a cellulose nitrate film, cellulose acetate film, polyvinyl acetal film, polystyrene film, polyethylene terephthalate film, and other polyester films as well as a glass sheet, a paper, a metal foil or sheet, a wood, etc. A support such as a paper coated or laminated with a polymer of α-olefin, in particular a polymer of α-olefin having two or more carbon atoms, such as polyethylene, polypropylene, ethylene butene copolymer, etc., gives good results.

The silver halide photographic emulsion layers and other photographic layers existing in the photographic elements prepared according to this invention can be hardened by a proper hardening agent. Examples of the hardening agent used for the purpose are an aldehyde hardening agent such aa formaldehyde, mucochloric acid, etc.; an aziridine hardening agent; a hardening agent composed of a dioxane derivative; an oxypolysaccharide such as oxy starch, etc.

Practical examples of the hardening agent used in this invention are described in "Product Licensing Index", Vol. 92, "Hardners" at page 108.

The silver halide photographic emulsion layers of this invention may further contain other additives, in particular those which are known to be useful for photographic emulsions, such as lubricants, stabilizers, speed increasing agents, light-absorptive dyes, plasticizers, etc.

The silver halide emulsions of this invention may further contain a coating aid. Examples of the coating aid used in this invention are described in "Product Licensing Index", Vol. 92, "Coating Aids" at page 108.

The silver halide emulsions of this invention can further contain a compound (e.g., potassium iodide) capable of releasing an iodide ion. In this invention, a desired image can be obtained using a developer containing an iodide ion.

In the case of preparing the photographic materials of this invention, it is frequently advantageous to use surface active agents or a mixture of them. Proper surface active agents include nonionic, ionic and amphoteric surface active agents, such as, for example, polyoxyalkylene derivatives, amphoteric aminoacid despersing agents (including sulfobetaines), etc. Examples of these surface active agents are described in U.S. Pat. Nos. 2,600,831; 2,271,622, 2,271,623; 2,275,727; 2,787,604; 2,816,920; and 2,739,891, and Belgian Pat. No. 652,862.

The silver halide photographic emulsions of this invention may contain polyalkylene oxide or the derivatives thereof such as the ether, ester, amine, etc., thioether compounds, thiomorpholines, quaternary ammonium salts, urethane derivatives, urea derivatives, imidazole derivatives, 3-pyrazolidones, etc., for the purposes of increasing sensitivity, increasing contrast, and accelerating the development. Practical examples of these materials used for the purposes are described in, for example, U.S. Pat. Nos. 2,400,532; 2,423,549; 2,716,062; 3,617,280; 3,772,021; 3,808,003, etc.

The silver halide photographic emulsions of this invention may contain antifoggants and stabilizers. Practical examples of these compounds are described in "Product Licensing Index", Vol. 92, "Antifoggants and Stabilizers", at page 107.

According to this invention, in a process of obtaining a direct positive image by surface-developing internal latent image type silver halide photographic emulsion layers in the presence of a fogging agent, a direct positive image having the high maximum density and sufficient low minimum density can be obtained at high developing progress.

Also, according to this invention, in a diffusion transfer process, in particular a color diffusion transfer process for obtaining a direct positive image by surface-developing the internal latent image type silver halide photographic emulsion layers in the presence of a fogging agent, a direct positive image having the high maximum density can be obtained at a high development progress.

Furthermore, the effect of this invention becomes more remarkable by adding a development inhibitor such as benzotriazole to the internal latent image type silver halide emulsions as described in U.S. Pat. No. 2,497,917.

The feature of this invention is in the point of obtaining the high maximum density, the sufficiently low minimum density, and a high development progress by using the sensitizing dyes and the compounds of this invention in the case of performing the surface development in the presence of a fogging agent.

The invention will now be explained more practically by the following examples. However, the scope of the invention is not limited to those examples.

EXAMPLE 1

Each of two kinds of photosensitive element 1 and 2 was prepared by coating, in succession, the following layers on a transparent polyethylene terephthalate support.

(1) Dyeing layer containing 3.0 g/m² of the copolymer described in U.S. Pat. No. 3,898,088 having the repeating unit shown below at the following ratio

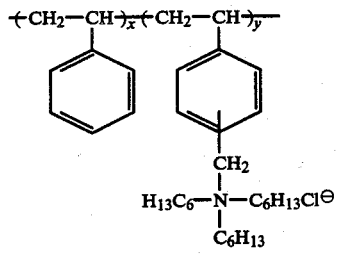

X:Y = 50:50 and 3.0 g/m² of gelatin.

(2) White reflecting layer containing 20 g/m² of titanium oxide and 20 g/m² of gelatin.

(3) Shading layer containing 2.7 g/m² of carbon black and 2.7 g/m² of gelatin.

(4) Layer containing 0.45 g/m² of the magenta DRR compound having the following formula, 0.10 g/m² of diethyl laurylamide, 0.0074 g/m² of 2,5-di-t-butylhydroquinone, and 0.76 g/m² of gelatin.

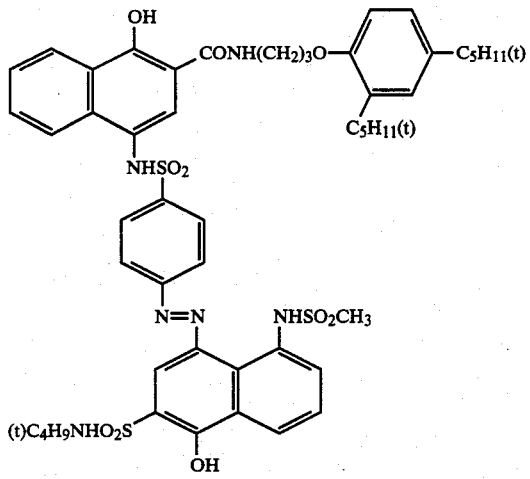

(5) Green-sensitive internal latent image type direct positive silver iodobromide emulsion (silver iodide 2 mole %) layer containing an internal latent image type silver iodobromide emulsion (1.4 g/m$^2$ as silver amount), 2,2 mg/m$^2$ of the green sensitizing dye 1–3, 0.5 mg/m$^2$ of the Compound VI-2 (for only photosensitive element 2 and the compound was not used in the case of photosensitive element 1), 0.05 mg/m$^2$ of a fogging agent having the following formula, and 0.11 g/m$^2$ of sodium 5-pentadecyl-hydroquinone-2-sulfonate

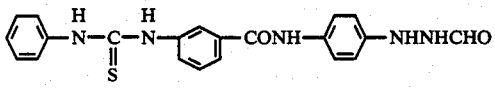

(6) Layer containing 0.94 g/m$^2$ of gelatin.

Each of the foregoing photosensitive elements 1 and 2 was combined with the elements described hereinafter and then processed as shown below.

| Processing composition: | |
|---|---|
| 1-Phenyl-4-methyl-4-hydroxymethyl-3-pyrazolidinone | 10 g |
| Methylhydroquinone | 0.18 g |
| 5-Methylbenztriazole | 4.0 g |
| Sodium sulfite (anhydrous) | 1.0 g |
| Carboxymethyl cellulose sodium salt | 40.0 g |
| Carbon black | 150 g |
| Potassium hydroxide (28% aq. soln.) | 200 ml |
| Water | 550 ml. |

The processing composition (0.8 g each) was filled in pressure rupturable containers.

Cover sheet:

A cover sheet was prepared by forming on a polyethylene terephthalate support an acid polymer layer (neutralizing layer) composed of 15 g/m$^2$ of polyacrylic acid (viscosity of about 1,000 c.p. as a 10% by weight aqueous solution) and a neutralization timing layer composed of 3.8 g/m$^2$ of acetyl cellulose (forming 39.4 g of acetyl group by the hydrolysis of 100 g of the acetyl cellulose) and 0.2 g/m$^2$ of a copolymer of styrene and maleic anhydride (mole ratio: styrene:maleic anhydride=about 60:40, molecular weight: about 50,000).

Processing step:

The aforesaid cover sheet was superposed on the above-described photosensitive element and after exposing a color test chart from the cover sheet side, the foregoing processing composition was spread between both sheets in a thickness of 75 microns (spreading of the composition was performed by means of a press roller). The development was performed at 25° C. Thereafter, the green filtered density of the image formed in the image-receiving layer (dyeing layer) was measured through the transparent support of the photosensitive element by means of a Macbeth reflection densitometer after one hour since the processing. The results are shown in Table 1.

TABLE 1

| Photosensitive Element | Sensitizing Dye (mg/m$^2$) | | Compound (mg/m$^2$) | | Dmax | Dmin |
|---|---|---|---|---|---|---|
| 1 | I-3 | 2.2 | none | | 1.74 | 0.22 |
| 2 | I-3 | 2.2 | VI-2 | 0.5 | 2.30 | 0.21 |

As is clear from the above results, the photosensitive element 2 prepared using the silver halide emulsion of this invention shows higher Dmax and lower Dmin than those of the comparison photosensitive element 1 prepared in conventional manner.

EXAMPLE 2

Each of photosensitive elements 3 to 5 and 6 to 12, and 13 to 20 was prepared by coating, in succession, the following layers on a transparent polyethylene terephthalate support.

(1) Dyeing layer having the same composition as that in Example 1.

(2) White reflecting layer having the same composition as that in Example 1.

(3) Shading layer having the same composition as that in Example 1.

(4) Layer having the same composition as the layer (4) in Example 1.

(5) Green-sensitive internal latent image type direct positive silver bromide emulsion layer containing an internal latent image type silver bromide emulsion (1.4 g/m$^2$ as silver amount), the green-sensitive sensitizing dye of general formula I to IV as shown in the following tables in an amount shown in the same table, the compound of general formula V or VI in an amount shown in the following tables, 0.05 mg/m$^2$ of the fogging agent as used in Example 1, and 0.11 g/m$^2$ of sodium 5-pentadecyl-hydroquinone-2-sulfonate.

(6) Layer having the same composition as the layer (6) in Example 1.

Each of the photosensitive elements prepared was combined with the cover sheet as in Example 1 and processed by spreading the processing composition as in Example 1. The results are shown in Table 2 to Table 4.

TABLE 2

| Photosensitive Element | Sensitizing Dye (mg/m$^2$) | | Compound (mg/m$^2$) | | Dmax | Dmin |
|---|---|---|---|---|---|---|
| 3 | I-3 | 1.7 | none | | 1.50 | 0.21 |
| | II-2 | 1.0 | | | | |
| 4 | I-3 | 1.7 | VI-2 | 0.5 | 2.24 | 0.22 |
| | II-2 | 1.0 | | | | |
| 5 | I-3 | 1.7 | V-5 | 0.5 | 1.96 | 0.22 |
| | II-2 | 1.0 | | | | |

TABLE 3

| Photosensitive Element | Sensitizing Dye (mg/m²) | | Compound (mg/m²) | | Dmax | Dmin |
|---|---|---|---|---|---|---|
| 6 | none | | VI-3 | 0.5 | 1.65 | 0.22 |
| 7 | I-2 | 2.5 | VI-3 | 0.5 | 2.02 | 0.22 |
| 8 | I-7 | 2.5 | VI-3 | 0.5 | 2.20 | 0.22 |
| 9 | II-1 | 2.5 | VI-3 | 0.5 | 1.98 | 0.22 |
| 10 | II-4 | 2.5 | VI-3 | 0.5 | 2.10 | 0.22 |
| 11 | II-6 | 2.5 | VI-3 | 0.5 | 2.00 | 0.22 |
| 12 | II-8 | 2.5 | VI-3 | 0.5 | 1.92 | 0.22 |

TABLE 4

| Photosensitive Element | Sensitizing Dye (mg/m²) | | Compound (mg/m²) | | Dmax | Dmin |
|---|---|---|---|---|---|---|
| 13 | none | | V-11 | 0.5 | 1.67 | 0.22 |
| 14 | III-5 | 2.5 | V-11 | 0.5 | 1.89 | 0.22 |
| 15 | III-7 | 2.5 | V-11 | 0.5 | 1.95 | 0.23 |
| 16 | IV-1 | 2.5 | V-11 | 0.5 | 2.01 | 0.23 |
| 17 | IV-3 | 2.5 | V-11 | 0.5 | 2.13 | 0.23 |
| 18 | IV-4 | 2.5 | V-11 | 0.5 | 2.07 | 0.23 |
| 19 | IV-16 | 2.5 | V-11 | 0.5 | 1.92 | 0.22 |
| 20 | IV-17 | 2.5 | V-11 | 0.5 | 1.92 | 0.22 |

As is clear from the results shown in Table 2, the photosensitive elements 4 and 5 prepared using the silver halide emulsions of this invention have higher Dmax than the comparison photosensitive element 3 prepared by the conventional manner and the Dmin of the former is almost the same as that of the latter.

Also, as is clear from the results shown in Table 3 and Table 4, by the combinations of the sensitizing dyes of general formula I to IV and the compounds of general formula V to VI provided by the invention, photosensitive materials having sufficiently high Dmax can be obtained almost without increasing Dmin.

EXAMPLE 3

Each of photosensitive sheets 21 to 39 were prepared by coating, in succession, the following layers on a transparent polyethylene terephthalate support.

(1) Dyeing layer having the same composition as in Example 1.

(2) White reflecting layer having the same composition as in Example 1.

(3) Shading layer having the same composition as in Example 1.

(4) Layer containing 0.5 g/m² of the DRR compound having the following formula, 0.25 g/m² of diethyllaurylamide, and 1.14 g/m² of gelatin.

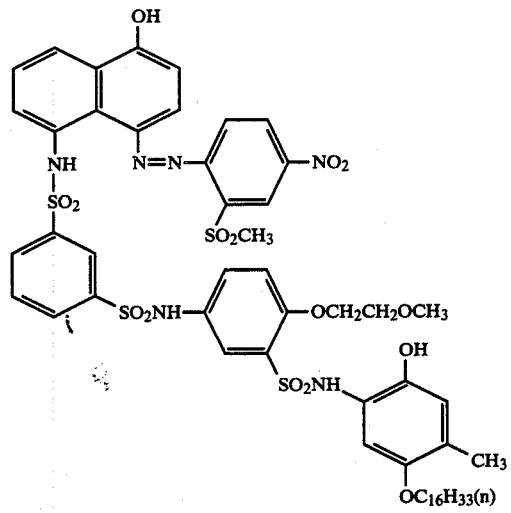

(5) Red-sensitive internal latent image type direct positive silver bromide emulsion layer containing an internal latent image type silver halide emulsion (1.9 g/m² as silver amount), 1.5 mg/m² a red-sensitive sensitizing dye having the following chemical formula, 0.07 mg/m² of the fogging agent as in Example 1, and 0.13 g/m² of sodium 5-pentadecylhydroquinone-2-sulfonate.

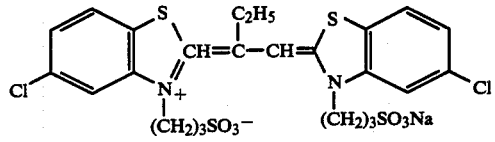

(6) Layer containing 2.6 g/m² of gelatin and 1.0 g/m² of 2,5-dioctylhydroquinone.

(7) Layer having the same composition as the layer (4) in Example 1 except that the layer of this case contained the magenta DRR compound having the formula:

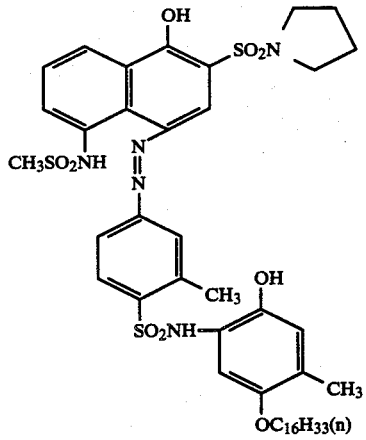

(8) Green-sensitive internal latent image type direct positive silver bromide emulsion layer containing an internal latent image type silver halide emulsion (1.4 g/m² as silver amount), green-sensitive sensitizing dyes (1.7 mg/m² of Sensitizing dye I-3 and 1.0 mg/m² of Sensitizing dye IV-2), the compound of general formula V or VI shown in the following tables in the amount shown in the same tables, 0.05 mg/m$^2$ of the fogging agent as in Example 1, and 0.11 g/m$^2$ of sodium 5-pentadecyl-hydroquinone-2-sulfonate.

(9) Layer having the same composition as the layer (6) described above.

(10) Layer containing 0.78 g/m$^2$ of the yellow DRR compound having the following formula, 0.16 g/m$^2$ of diethyllaurylamide, 0.012 g/m$^2$ of 2,5-di-t-butylhydroquinone, and 0.78 g/m$^2$ of gelatin.

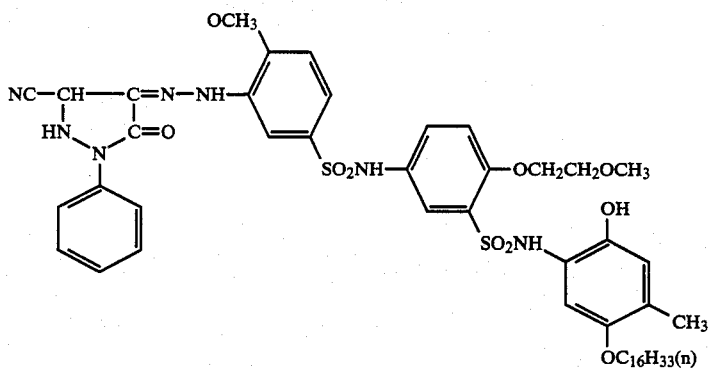

(11) Blue-sensitive internal latent image type direct positive silver bromide emulsion layer containing an internal latent image type silver halide emulsion (2.2 g/m$^2$ as silver amount), 1.9 mg/m$^2$ of blue-sensitive sensitizing dye having the following chemical formula, 0.08 mg/m$^2$ of the fogging agent as in Example 1, and 0.094 g/m$^2$ of sodium 5-pentadecylhydroquinone-2-sulfonate.

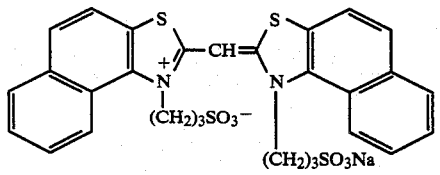

(12) Layer containing 0.94 g/m$^2$ of gelatin.

Processing solution:

Same as used in Example 1.

Cover sheet:

The cover sheet was prepared by coating, in succession, the following layers on a polyethylene terephthalate support.

(1) In 1 kg of a 20% solution (solvent was a mixture of water and acetone at 3:1 by volume ratio) of a copolymer of acrylic acid and butyl acrylate (8:2 by mole ratio) having a mean molecular weight of 50,000 was dissolved 3.8 g of 5-(2-cyanoethylthio)-1-phenyltetrazole and the resultant solution was coated on the foregoing support at 110 g/m$^2$ to form a layer of about 20μ in thickness.

(2) In a mixed solvent of acetone and cyclohexanone (3:1 by volume ratio) were dissolved 55 g of cellulose acetate having an acetyl value of 52.1% (the amount of acetic acid released by the hydrolysis of the cellulose acetate was 0.521 g per gram of the sample) and 5 g of a copolymer of styrene and maleic anhydride (1:1 by mole ratio) having a mean molecular weight of 10,000 and the resultant solution was coated on the above-formed layer at 50 g/m$^2$ to form a layer of about 2.6μ in thickness.

(3) A solution (10% solid component) of a polymer latex prepared by emulsion polymerizing a mixture of styrene, butyl acrylate, and acrylic acid at 52:42:6 by weight ratio was coated on the aforesaid layer at 30 ml/m$^2$ Processing step:

The aforesaid cover sheet was superposed on the above-mentioned photosensitive element and after performing image-exposure through a continuous gradation wedge from the cover sheet side, the aforesaid processing composition was spread between both sheets at a thickness of 80μ. The spreading was performed by means of a press roller and the development was performed at 25° C. The photographic properties of the color positive images obtained in each sheet after processing are shown in Table 5 and Table 6.

TABLE 5

| Photosensitive Element | Compound | Amount (mg/m$^2$) | Dmax | Dmin |
|---|---|---|---|---|
| 21 | none | — | 1.98 | 0.22 |
| 22 | VI-9 | 0.5 | 2.19 | 0.22 |
| 23 | VI-11 | 0.5 | 2.25 | 0.22 |
| 24 | VI-2 | 0.5 | 2.38 | 0.22 |
| 25 | VI-4 | 0.5 | 2.29 | 0.22 |
| 26 | VI-8 | 0.5 | 2.18 | 0.22 |
| 27 | VI-13 | 0.5 | 2.36 | 0.22 |
| 28 | VI-14 | 0.5 | 2.31 | 0.22 |
| 29 | VI-17 | 0.5 | 2.22 | 0.22 |

TABLE 6

| Photosensitive Element | Compound | Amount (mg/m$^2$) | Dmax | Dmin |
|---|---|---|---|---|
| 30 | none | — | 1.80 | 0.22 |
| 31 | V-1 | 0.5 | 2.14 | 0.22 |
| 32 | V-13 | 0.5 | 2.35 | 0.22 |
| 33 | V-10 | 0.5 | 2.21 | 0.22 |
| 34 | V-16 | 0.5 | 2.35 | 0.22 |
| 35 | V-3 | 0.5 | 2.20 | 0.22 |
| 36 | V-8 | 0.5 | 2.08 | 0.22 |
| 37 | V-5 | 0.5 | 2.13 | 0.22 |
| 38 | V-21 | 0.5 | 2.38 | 0.22 |
| 39 | V-17 | 0.5 | 2.40 | 0.22 |

As is clear from the above results, the photosensitive elements 22 to 29 and 31 to 39 prepared using the silver halide emulsions of this invention have higher Dmax than comparison photosensitive elements 21 and 30 prepared by the conventional manner and have sufficient low Dmin.

EXAMPLE 4

Each of photosensitive elements 40 and 41 was prepared by coating, in succession, the following layers on a transparent polyethylene terephthalate support.

(1) Dyeing layer having the same composition as that in Example 1.

(2) White reflective layer having the same composition as that in Example 1.

(3) Shading layer having the same composition as that in Example 1.

(4) Layer containing the magenta DRR compound and gelatin as in Example 1.

(5) Internal latent image type direct positive silver bromide emulsion layer containing an internal latent image type silver bromide emulsion (1.4 g/m$^2$ as silver amount), sensitizing dyes (1.7 mg/m$^2$ of Sensitizing dye I-3 and 1.0 mg/m$^2$ of Sensitizing dye II-2), the compound of general formula VI as shown in Table 7 in the amount shown in the same table, 0.05 mg/m$^2$ of the fogging agent as in Example 1, and 0.11 g/m$^2$of sodium 5-pentadecylhydroquinone-2-sulfonate.

(6) The same layer containing gelatin as the layer (12) in Example 3.

Each of the photosensitive elements was processed as in Example 1 using the processing composition and the cover sheet as used in Example 1. The results obtained are shown in Table 7.

TABLE 7

| Photosensitive Element | Compound | Amount (mg/m$^2$) | Dmax | Dmin |
|---|---|---|---|---|
| 40 | — | — | 1.72 | 0.22 |
| 41 | VI-2 | 0.5 | 2.44 | 0.22 |

As is clear from the above results, it is understood that by using the compounds of this invention, higher Dmax and sufficient lower Dmin are obtained.

EXAMPLE 5

Each of photographic materials (I) and (II) was prepared by coating, in succession, the following layers on a polyethylene terephthalate film support imparted with shading property by kneading therewith 12% by weight cargon black.

Photographic material (I):

(1) Layer containing 0.80 g/m$^2$ of the magenta dye-releasing redox compound having the following formula, 0.20 g/m$^2$ of N,N-diethyllaurylamide, and 1.2 g/m$^2$ of gelatin.

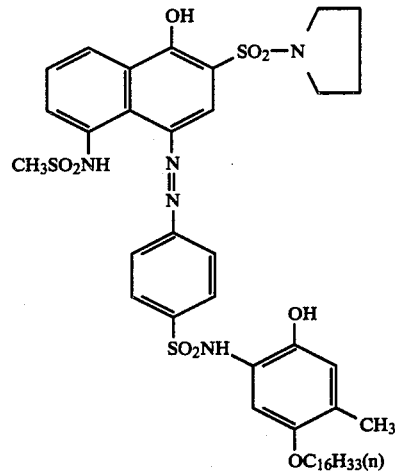

(2) Layer containing a green-sensitive internal latent image type silver bromide emulsion (1.1 g/m$^2$ of gelatin and 1.4 g/m$^2$ of silver) containing Sensitizing dye I-3 (2.2 mg/m$^2$), 0.015 g/m$^2$ of 1-acetyl-2-[4-(2,4-di-t-pentylphenoxyacetamido)-phenyl]-hydrazine, and 0.067 g/m$^2$ of sodium 2-pentadecylhydroquinone-5-sulfonate.

(3) Layer containing 1.0 g/m$^2$ of gelatin.

Photographic material (II):

Same as the photographic material (I) except that the layer (2) further contained $2.0\times10^{-4}$ g/m$^2$ of the compound VI-2.

Each of the photographic materials was imagewise exposed through a continuous wedge to tungsten light of 2854° K. converted into light of 4800° K. through a Davis-Gibson filter (the maximum exposure amount in this case was 10 C.M.S.). The exposed film was developed by the processing solution having the following composition.

| Processing composition: | |
|---|---|
| Potassium hydroxide | 56 g |
| 4-Hydroxymethyl-4-methyl-1-p-tolyl-3-pyrazolidinone | 6 g |
| 5-methylbenzotriazole | 5 g |
| Methylhydroquinone | 0.2 g |
| Sodium sulfite | 0.8 g |
| Benzyl alcohol | 2 ml |
| Hydroxyethyl cellulose | 50 g |
| Water to make | 1 liter |

On the other hand, an image-receiving sheet was prepared by coating, in succession, the following layers on a paper support on the opposite surface of which was laminated with polyethylene containing carbon black to provide shading property to the paper support.

(1) Neutralizing layer containing 17 g/m$^2$ of polyacrylic acid, 0.06 g/m$^2$ of N-hydroxysuccinimidobenzene sulfonate, and 0.5 g/m$^2$ of ethylene glycol and having a thickness of 7$\mu$.

(2) Timing layer formed by coating cellulose acetate (acetyl value of 54 at a thickness of 2$\mu$.)

(3) Timing layer formed by a copolymer latex of vinylidene chloride and acrylic acid at a thickness of 4$\mu$.

(4) Image-receiving layer containing 4.0 g/m$^2$ of a styrene-N-vinylbenzyl-N,N,N-trihexylammonium chloride copolymer and 4.0 g/m$^2$ of gelatin.

(5) Separable layer containing 2.0 g/m$^2$ of phthalated gelatin.

The foregoing processing composition was filled in a rupturable container and was uniformly spread between the image-receiving sheet and the image-wize exposed photographic material by passing them between a pair of juxtaposed rollers at 25° C.

After 2 minutes since spreading the processing composition, the image-receiving sheet was separated from the photographic material and the density of the image formed in the image-receiving sheet was measured. The results obtained are shown in Table 8.

TABLE 8

| Photographic Material | Dmax (G)* | Dmin (G) |
|---|---|---|
| (I) | 1.66 | 0.08 |
| (II) | 2.00 | 0.08 |

*G: Green filtered density

From the above results, it is understood that the compounds of this invention can increase Dmax without substantially changing Dmin.

While the invention has been described in detail and with reference to specific embodiments thereof, it will be apparent to one skilled in the art that various changes and modifications can be made therein without departing from the spirit and scope thereof.

What is claimed is:

1. An internal latent image-type direct positive silver halide photographic emulsion containing a fogging agent which, during development or pre-bath processing, preferentially forms surface development nuclei comprising at least one sensitizing dye selected from the group consisting of dyes represented by general formulae II, and IV and the compound represented by general formula V;

Formula II

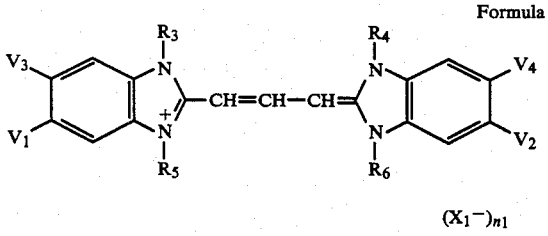

wherein $V_1$, $V_2$, $V_3$, and $V_4$ each represents a hydrogen atom, a halogen atom, a trifluoromethyl group, a cyano group, a carboxy group, an alkoxycarbonyl group, an aminosulfonyl group, or an alkylsulfonyl group; $R_3$, $R_4$, $R_5$, and $R_6$ each represents an alkyl group or a substituted alkyl group; $X_1$ represents an acid anion; and $n_1$ represents 0 or 1;

Formula IV

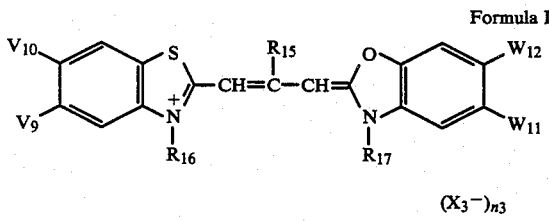

wherein $R_{15}$ represents an alkyl group; $R_{16}$ and $R_{17}$ each represents an alkyl group or a substituted alkyl group; $V_9$, $V_{10}$, $W_{11}$ and $W_{12}$ each has the same significance as $W_1$ in general formula I; $X_3$ represents an acid anion; and $n_3$ represents 0 or 1;

Formula V

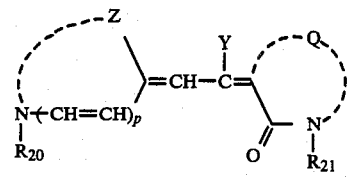

wherein Z represents a non-metallic atomic group necessary for completing a thiazole nucleus, a thiazoline nucleus, a selenazole nucleus, a selenazoline nucleus, a pyrrolidine nucleus, a pyridine nucleus, an oxazole nucleus, an oxazoline nucleus, an imidazole nucleus, an indolenine nucleus, a tetrazole nucleus, a benzothiazole nucleus, a benzoselenazole nucleus, a benzimidazole nucleus, a benzoxazole nucleus, a naphthoxathiazole nucleus, a napthoselenazole nucleus, a naphthoxazole nucleus, a napthoimidazole nucleus, or a quinoline nucleus; Q represents a non-metallic atomic group necessary for completing a rhodanine nucleus, a 2-thiooxazolidine-2,4-dione nucleus, 2-thioselenazolidine-2,4-dione nucleus, a barbituric acid nucleus, a 2-thiobarbituric acid nucleus, or a 2-thiohydantion nucleus; $R_{20}$ and $R_{21}$ each represents a hydrogen atom, an alkyl group, a substituted alkyl group, an aryl group, or an allyl group; Y represents a hydrogen atom, an alkyl group, or an aryl group; and p represents 0 or 1.

2. A direct positive silver halide photographic emulsion as claimed in claim 1, wherein said sensitizing dye is contained in an amount of from $1.0\times10^{-5}$ to $5.0\times10^{-4}$ mole per mole of silver halide.

3. A direct positive silver halide photographic emulsion as claimed in claim 1, wherein said compound is contained in an amount of from $1.0\times10^{-5}$ and $5.0\times10^{-4}$ mole per mole of silver halide.

4. A direct positive silver halide photographic emulsion as claimed in claim 1, wherein the emulsion further contains at least one sensitizing dye selected from the group consisting of dyes represented by general formulae VII and VIII:

Formula VII

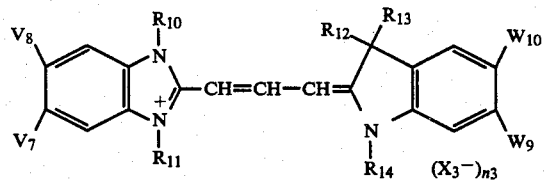

wherein $V_7$, $V_8$, $R_{10}$, and $R_{11}$ each has the same significance as $V_1$, $V_3$, $R_3$ and $R_5$, respectively, in general formula II; $R_{12}$ and $R_{13}$ each represents an alkyl group; $R_{14}$ represents an alkyl group or a substituted alkyl group; $W_9$ and $W_{10}$ each represents a hydrogen atom, a halogen atom, an alkyl atom, an alkoxy group, a hydroxy group, an acyloxy group, or a phenyl group; $X_3$ represents an acid anion; and $n_3$ represents 0 or 1;

Formula VIII

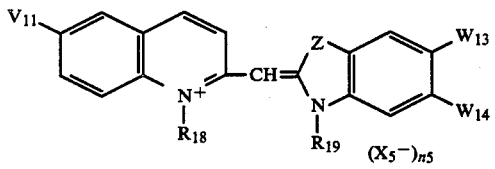

wherein $V_{11}$ represents a hydrogen atom, a halogen atom, an alkyl group, a hydroxy group, an acyloxy group, or a phenyl group; $Z_2$ represents an oxygen atom, a sulfur atom, a selenium atom, or —CH=CH—; $W_{13}$ and $W_{14}$ each represents a hydrogen atom, a halogen atom, an alkyl group, an alkoxy group, a hydroxy group, an acyloxy group, or a phenyl group; $R_{18}$ and $R_{19}$ each represents an alkyl group or a substituted alkyl group; $X_5$ represents an acid anion; and $n_5$ represents 0 or 1.

5. A direct positive silver halide photographic emulsion as claimed in claim 4, wherein said sensitizing dye selected from the group consisting of dyes represented by general formulae VII and VIII is contained in an amount of $1.0\times10^{-5}$ to $5\times10^{-4}$ mole per mole of silver halide.

6. A direct positive silver halide photographic emulsion as claimed in claim 1, wherein the amount of the fogging agent is 50 to 15,000 mg per mole of silver.

7. A direct positive silver halide photographic emulsion as claimed in claim 1, wherein the emulsion further contains a dye image-forming coupler.

8. A direct positive silver halide photographic emulsion as claimed in claim 1, wherein the emulsion further contains a developing agent.

9. A direct positive silver halide photographic emulsion as claimed in claim 1, wherein the molar ratio of said sensitizing dye to the amount of said compound is 1/10 to 10.

10. A direct positive silver halide photographic emulsion as claimed in claim 4, wherein the molar ratio of the amount of said sensitizing dyes selected from the group consisting of dyes represented by the general formulae II and IV to the amount of said sensitizing dyes selected form the group consisting of dyes represented by the general formulae VII and VIII is 1/10 to 10.

11. A method for obtaining a direct positive image by the application of surface development in the presence of a fogging agent after image exposure wherein said method employs a photographic material, comprising a support having thereon at least one layer of an internal latent image type silver halide emulsion containing at least one sensitizing dye selected from the group consisting of dyes represented by general formulae II and IV and the compound represented by following general formula V Formula II

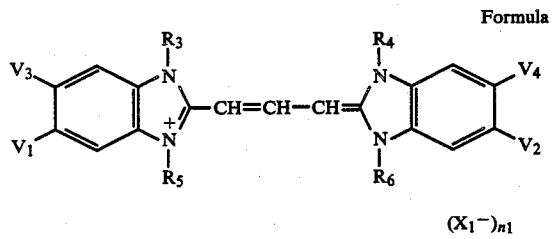

wherein $V_1$, $V_2$, $V_3$, and $V_4$ each represents a hydrogen atom, a halogen atom, a trifluoromethyl group, a cyano group, a carboxy group, an alkoxycarbonyl group, an aminosulfonyl group, or an alkylsulfonyl group; $R_3$, $R_4$, $R_5$, and $R_6$ each represents an alkyl group or a substituted alkyl group; $X_1$ represents an acid anion; and $n_1$ represents 0 or 1;

Formula IV

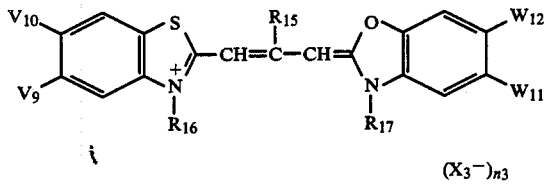

wherein $R_{15}$ represents an alkyl group; $R_{16}$ and $R_{17}$ each represents an alkyl group or a substituted alkyl group; $V_9$, $V_{10}$, $W_{11}$, and $W_{12}$ each has the same significance as $W_1$ in general formula I; $X_3$ represents an acid anion; and $n_3$ represents 0 or 1;

Formula V

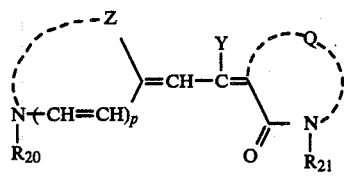

wherein Z represents a non-metallic atomic group necessary for completing a thiazole nucleus, a thiazoline nucleus, a selenazole nucleus, a selenazoline nucleus, a pyrrolidine nucleus, a pyridine nucleus, an oxazole nucleus, an oxazoline nucleus, an imidazole nucleus, an indolenine nucleus, a tetrazole nucleus, a benzothiazole nucleus, a benzoselenazole nucleus, a benzimidazole nucleus, a benzoxazole nucleus, a naphthothiazole nucleus, a naphthoselenazole nucleus, a naphthoxazole nucleus, a naphthoimidazole nucleus, or a quinoline nucleus; Q represents a non-metallic atomic group necessary for completing a rhodanine nucleus, a 2-thiooxazolidine-2,4-dione nucleus, a 2-thioselenazolidine-2,4-dione nucleus, a barbituric acid nucleus, a 2-thobarbituric acid nucleus, or a 2-thiohydantoin nucleus; $R_{20}$ and $R_{21}$ each represents a hydrogen atom, an alkyl group, a substituted alkyl group, an aryl group, or an allyl group; Y represents a hydrogen atom, an alkyl group, or an aryl group; and p represents 0 or 1.

12. The method as claimed in claim 11, wherein said internal latent image type silver halide emulsion layer further contains at least one sensitizing dye selected from the group consisting of dyes represented by general formulae VII and VIII;

Formula VII

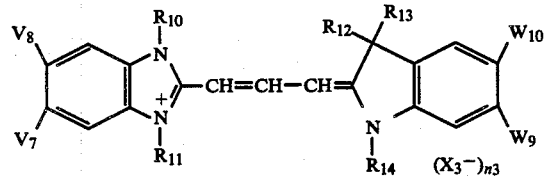

wherein $V_7$, $V_8$, $R_{10}$, and $R_{11}$ each has the same significance as $V_1$, $V_3$, $R_3$, and $R_5$, respectively, in general formula II; $R_{12}$ and $R_{13}$ each represents an alkyl group;

$R_{14}$ represents an alkyl group or a substituted alkyl group; $W_9$ and $W_{10}$ each represents a hydrogen atom, a halogen atom, an alkyl group, an alkoxy group, a hydroxy group, an acyloxy group, or a phenyl group; $X_3$ represents an acid anion; and $n_3$ represents 0 or 1;

Formula VIII

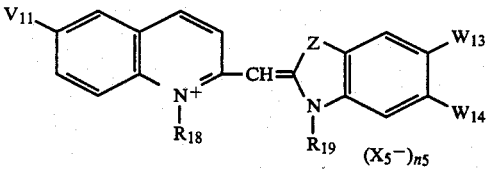

wherein $V_{11}$ represents a hydrogen atom, a halogen atom, an alkyl group, a hydroxy group, an acyloxy group, or a phenyl group; $Z_2$ represents an oxygen atom, a sulfur atom, a selenium atom, or —CH=CH—; $W_{13}$ and $W_{14}$ each represents a hydrogen atom, a halogen atom, an alkyl group, an alkoxy group, a hydroxy group, an acyloxy group, or a phenyl group; $R_{18}$ and $R_{19}$ each represents an alkyl group or a substituted alkyl group; $X_5$ represents an acid anion; and $n_5$ represents 0 or 1.

13. A diffusion transfer photographic material comprising a photosensitive unit having at least one layer of an internal latent image type direct positive silver halide emulsion associated with a non-diffusible dye image-providing material capable of releasing a diffusible dye in proportion to the amount of developed silver in said silver halide emulsion layer, a dyeing unit for receiving said diffusible dye, and a processing composition unit for processing the photosensitive unit, said internal latent image type silver halide emulsion containing at least one sensitizing dye selected from the group consisting of dyes represented by general formulae II and IV and the compound represented by general formula V Formula II

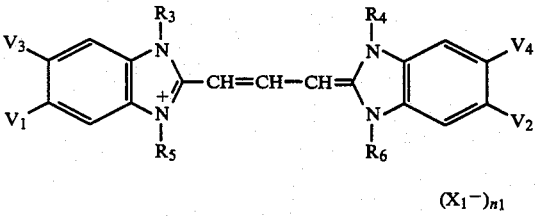

wherein $V_1$, $V_2$, $V_3$, and $V_4$ each represents a hydrogen atom, a halogen atom, a trifluoromethyl group, a cyano group, a carboxy group, an alkoxycarbonyl group, an aminosulfonyl group, or an alkylsulfonyl group; $R_3$, $R_4$, $R_5$, and $R_6$ each represents an alkyl group or substituted alkyl group $X_1$ represents an acid anion; and $n_1$ represents 0 or 1;

Formula IV

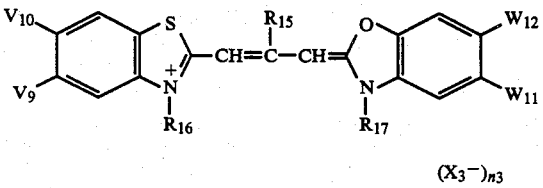

wherein $R_{15}$ represents an alkyl group; $R_{16}$ and $R_{17}$ each represents an alkyl group or a substituted alkyl group $V_9$, $V_{10}$, $W_{11}$, and $W_{12}$ each has the same significance as $W_1$ in general formula I; $X_3$ represents an acid anion; and $n_3$ represents 0 or 1;

Formula V

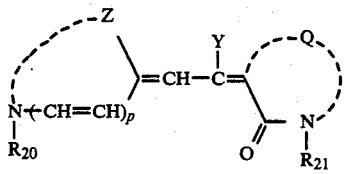

wherein Z represents a non-metallic atomic group necessary for completing a thiazole nucleus, a thiazoline nucleus, a selenazole nucleus, a selenazoline nucleus, a pyrrolidine nucleus, a pyridine nucleus, an oxazole nucleus, an oxazoline nucleus, an imidazole nucleus, an indolenine nucleus, a tetrazole nucleus, a benzothiazole nucleus, a benzoselenazole nucleus, a benzimidazole nucleus, a benzoxazole nucleus, a naphthothiazole nucleus, a naphthoselenazole nucleus, a naphthoxazole nucleus, a napthoimidazole nucleus, or a quinoline nucleus; Q represents a non-metallic atomic group necessary for completing a rhodanine nucleus, a 2-thiooxazolidine-2,4-dione nucleus, a 2-thioselenazolidine-2,4-dione nucleus, a barbituric acid nucleus, a 2-thoibarbituric acid nucleus, or a 2-thiohydantoin nucleus; $R_{20}$ and $R_{21}$ each represents a hydrogen atom, an alkyl group, a substituted alkyl group, an aryl group, or an allyl group; Y represents a hydrogen atom, an alkyl group, or an aryl group; and p represents 0 or 1 wherein said photographic material contains a fogging agent which, during development or pre-bath processing, preferentially forms surface development nuclei.

14. A diffusion transfer photographic material comprising a photosensitive unit comprising at least one layer of an internal latent image type silver halide emulsion associated with a non-diffusible dye image-providing material capable of releasing a diffusible dye in proportion to the amount of developed silver in said silver halide emulsion layer and a dyeing layer for receiving said diffusible dye, and a processing composition unit for processing the photosensitive unit, said internal latent image type silver halide emulsion contains at least one sensitizing dye selected from the group consisting of dyes represented by following general formulae II and IV and the compound represented by the following general formula V Formula II

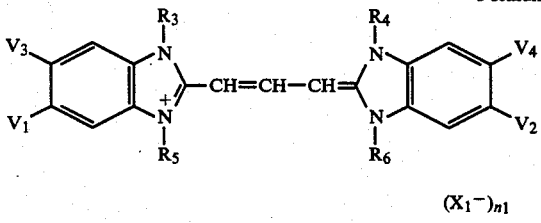

wherein $V_1$, $V_2$, $V_3$, and $V_4$ each represents a hydrogen atom, a halogen atom, a trifluoromethyl group, a cyano group, a carboxy group, an alkoxycarbonyl group, an aminosulfonyl group, or an alkylsulfonyl group; $R_3$, $R_4$, $R_5$, and $R_6$ each represents an alkyl group or substituted alkyl group; $X_1$ represents an acid anion; and $n_1$ represents 0 or 1;

Formula IV

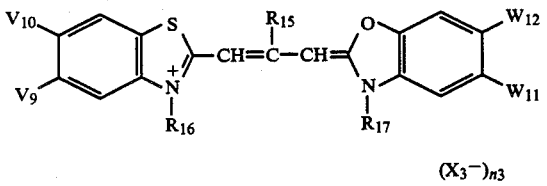

wherein $R_{15}$ represents an alkyl group; $R_{16}$ and $R_{17}$ each represents an alkyl group or a substituted alkyl group $V_9$, $V_{10}$, $W_{11}$, and $W_{12}$ each has the same significance as $W_1$ in general formula I; $X_3$ represents an acid anion; and $n_3$ represents 0 or 1;

Formula V

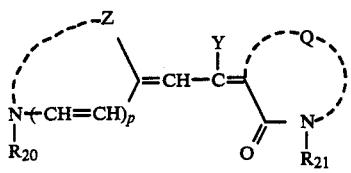

wherein Z represents a non-metallic atomic group necessary for completing a thiazole nucleus, a thiazoline. nucleus, a selenazole nucleus, a selenazoline nucleus, a pyrrolidine nucleus, a pyridine nucleus, an oxazole nucleus, an oxazoline nucleus, an imidazole nucleus, an indolenine nucleus, a tetrazole nucleus, a benzothiazole nucleus, a benzoselenazole nucleus, a benzimidazole nucleus, a benzoxazole nucleus, a naphthothiazole nucleus, a naphthoselenazole nucleus, a naphthoxazole nucleus, a napthoimidazole nucleus, or a quinoline nucleus; Q represents a non-metallic atomic group necessary for completing a rhodanine nucleus, a 2-thiooxazolidine-2,4-dione nucleus, a 2-thioselenazolidine-2,4-dione nucleus, a barbituric acid nucleus, a 2-thoibarbituric acid nucleus, or a 2-thiohydantoin nucleus; $R_{20}$ and $R_{21}$ each represents a hydrogen atom, an alkyl group, a substituted alkyl group, an aryl group, or an allyl group; Y represents a hydrogen atom, an alkyl group, or an aryl group; and p represents 0 or 1 wherein said photographic material contains a fogging agent which, during development or pre-bath processing, preferentially forms surface development nuclei.

15. The method of claim 11 wherein said fogging agent is in said silver halide emulsion.

16. The material of claim 13, wherein said fogging agent is in the emulsion.

17. The material of claim 14, wherein said fogging agent is in the emulsion.

18. The method of claim 11 wherein the amount of the fogging agent is 50 to 15,000 mg per mole of silver.

19. The material of claim 13 wherein the amount of fogging agent is 50 to 15,000 mg per mole of silver.

20. The material of claim 14 wherein the amount of fogging agent is from 50 to 15,000 mg per mole of silver.

21. A diffusion transfer photographic material as claimed in claim 13, wherein said sensitizing dye is contained in an amount of from $1.0\times10^{-5}$ to $5\times10^{-4}$ mole per mole of silver halide.

22. A diffusion transfer photographic material as claimed in claim 13, wherein said compound is contained in an amount of from $1.0\times10^{-5}$ to $5\times10^{-4}$ mole per mole of silver halide.

23. A diffusion transfer photographic material as claimed in claim 13, wherein the emulsion further contains at least one sensitizing dye selected from the group consisting of dyes represented by general formulae VII and VIII Formula VII

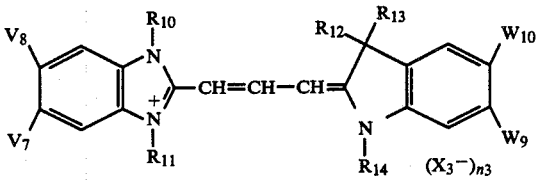

wherein $V_7$, $V_8$, $R_{10}$, and $R_{11}$ each has the same significance as $V_1$, $V_3$, $R_3$ and $R_5$, respectively, in general formula II; $R_{12}$ and $R_{13}$ each represents an alkyl group; $R_{14}$ represents an alkyl group or a substituted alkyl group; $W_9$ and $W_{10}$ each represents a hydrogen atom, a halogen atom, an alkyl group, an alkoxy group, a hydroxy group, an acyloxy group, or a phenyl group; $X_3$ represents an acid anion; and $n_3$ represents 0 or 1;

Formula VIII

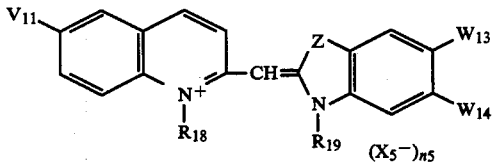

wherein $V_{11}$ represents a hydrogen atom, a halogen atom, an alkyl group, a hydroxy group, an acyloxy group, or a phenyl group; $Z_2$ represents an oxygen atom, a sulfur atom, a selenium atom, or —CH=CH—; $W_{13}$ and $W_{14}$ each represents a hydrogen atom, a halogen atom, an alkyl group, an alkoxy group, a hydroxy group, an acyloxy group, or a phenyl group; $R_{18}$ and $R_{19}$ each represents an alkyl group or a substituted alkyl group; $X_5$ represents an acid anion; and $n_5$ represents 0 or 1.

24. A diffusion transfer photographic material as claimed in claim 22, wherein said sensitizing dye selected from the group consisting of dyes represented by general formulae VII and VIII is contained in an amount of $1.0\times10^{-5}$ to $5\times10^{-4}$ mole per mole of silver halide.

25. A diffusion transfer photographic material as claimed in claim 13, wherein the emulsion further contains the fogging agent in an amount of from 50 to 15,000 mg per mole of Ag.

26. A diffusion transfer photographic material as claimed as in claim 13, wherein the emulsion further contains a dye image-forming coupler.

27. A diffusion transfer photographic material as claimed in claim 13, wherein the emulsion further contains a developing agent.

28. A diffusion transfer photographic material as claimed in claim 13, wherein the molar ratio of said sensitizing dye to the amount of said compound is 1/10 to 10.

29. A diffusion transfer photographic material as claimed in claim 23, wherein the molar ratio of the amount of said sensitizing dyes selected from the group consisting of dyes represented by the general formulae II and IV to the amount of said sensitizing dyes selected from the group consisting of dyes represented by the general formulae VII and VIII is 1/10 to 10.

30. The photographic material as claimed in claim 13, wherein said internal latent image type silver halide emulsion layer contains at least one sensitizing dye selected from the group consisting of dyes represented by general formulae II and IV and at least one compound selected from the group consisting of compounds represented by general Formula V.

31. A method for obtaining a direct positive image as claimed in claim 11, wherein said development is conducted using a developer containing an alkalifying agent.

32. A method for obtaining a direct positive image as claimed in claim 11, wherein said development is conducted using a developer having a pH from 10 to 13.

33. A method for obtaining a direct positive image as claimed in claim 11, wherein said fogging agent is in said photographic material.

34. A method for obtaining a direct positive image as claimed in claim 11, wherein said fogging agent is incorporated in a developer.

35. A method for obtaining a direct positive image as claimed in claim 11, wherein said fogging agent is incorporated in a developer in an amount of from 0.05 to 5 g per liter of the developer.

* * * * *